US011933046B1

(12) United States Patent
Attalla

(10) Patent No.: US 11,933,046 B1
(45) Date of Patent: Mar. 19, 2024

(54) STIFF WALL PANEL ASSEMBLY FOR A BUILDING STRUCTURE AND ASSOCIATED METHOD(S)

(71) Applicant: Anthony Attalla, Navarre, FL (US)

(72) Inventor: Anthony Attalla, Navarre, FL (US)

( * ) Notice: Subject to any disclaimer, the term of this patent is extended or adjusted under 35 U.S.C. 154(b) by 0 days.

(21) Appl. No.: 18/453,410

(22) Filed: Aug. 22, 2023

Related U.S. Application Data

(63) Continuation-in-part of application No. 18/190,092, filed on Mar. 26, 2023, which is a continuation-in-part of application No. 18/055,448, filed on Nov. 15, 2022, now Pat. No. 11,643,818.

(60) Provisional application No. 63/368,450, filed on Jul. 14, 2022.

(51) Int. Cl.
*E04C 2/08* (2006.01)
*E04C 2/38* (2006.01)

(52) U.S. Cl.
CPC ..... *E04C 2/08* (2013.01); *E04C 2/384* (2013.01)

(58) Field of Classification Search
CPC ..... E04C 2/08; E04C 2/384
USPC ..... 52/798.1
See application file for complete search history.

(56) References Cited

U.S. PATENT DOCUMENTS 2,157,359 A * 5/1939 Tapman ..... E04C 2/08 52/630
2,664,177 A * 12/1953 Hammitt ..... E04D 13/158 52/283
3,125,387 A * 3/1964 Abrahamson ..... A47B 13/06 312/265.5
3,217,452 A * 11/1965 Steele ..... E04B 2/7845 52/584.1
3,243,930 A * 4/1966 Slowinski ..... E04B 2/789 52/363
3,296,759 A * 1/1967 Pavlecka ..... B62D 31/02 52/234
3,415,026 A * 12/1968 Tillisch ..... E04B 1/04 52/262
3,779,622 A * 12/1973 Beaver ..... A47B 96/205 312/194
3,780,478 A * 12/1973 Pavlecka ..... E06B 1/04 52/568
3,809,449 A * 5/1974 Beaver ..... A47B 17/003 312/194

(Continued)

FOREIGN PATENT DOCUMENTS

CN 111764536 A * 10/2020
DK 201470705 A1 * 4/2016 ..... E04B 1/24

(Continued)

*Primary Examiner* — Brian D Mattei
*Assistant Examiner* — Joseph J. Sadlon
(74) *Attorney, Agent, or Firm* — Ashkan Najafi

(57) ABSTRACT

A modular stiff wall panel assembly, for a building structure, includes a modular wall panel including a body having a single, continuous, and unitary layer extended along an entire surface area of the wall panel, a plurality of studs engaged with the single, continuous, and unitary layer, a plurality of external reinforcement members engaged with the single, continuous, and unitary layer, and a plurality of internal reinforcement members engaged with the studs and oppositely spaced from the external reinforcement members. Each of the external reinforcement members and the internal reinforcement members have a hat-shaped (profile) cross-section.

19 Claims, 25 Drawing Sheets

(56) References Cited

U.S. PATENT DOCUMENTS 3,820,295 A * 6/1974 Folley ..... E04B 1/08 52/630
3,842,647 A * 10/1974 Knudson ..... B21D 11/08 72/196
3,845,601 A * 11/1974 Kostecky ..... E04B 1/2403 52/656.1
3,877,193 A * 4/1975 Hall ..... E04B 2/60 403/230
3,938,244 A * 2/1976 Merle ..... H01P 3/14 29/454
3,995,081 A * 11/1976 Fant ..... B29D 99/0014 428/184
3,999,352 A * 12/1976 Doke ..... F16B 5/045 52/690
4,030,246 A * 6/1977 Naylor ..... E06B 3/721 49/501
4,757,663 A * 7/1988 Kuhr ..... E04B 9/16 52/664
4,809,476 A * 3/1989 Satchell ..... E04B 2/76 52/843
4,914,883 A * 4/1990 Wencley ..... E04C 2/386 52/801.1
4,918,899 A * 4/1990 Karytinos ..... E04B 1/5818 52/690
5,157,883 A * 10/1992 Meyer ..... E04B 2/789 52/696
5,203,132 A * 4/1993 Smolik ..... E04B 2/7409 52/690
5,337,592 A * 8/1994 Paulson ..... B21D 13/04 72/196
5,394,665 A * 3/1995 Johnson ..... E04C 3/32 52/745.1
5,660,012 A * 8/1997 Knudson ..... B21D 39/034 52/656.1
6,170,217 B1 * 1/2001 Meyer ..... E04C 3/09 52/843
6,205,725 B1 * 3/2001 Butler ..... E04B 5/14 52/630
6,260,323 B1 * 7/2001 Hockey ..... E04B 2/74 52/537
6,279,284 B1 * 8/2001 Moras ..... E04F 13/007 52/483.1
6,374,558 B1 * 4/2002 Surowiecki ..... E04B 2/7457 52/690
6,568,138 B1 * 5/2003 Frost ..... E04B 2/767 52/656.1
6,647,691 B2 * 11/2003 Becker ..... E04B 2/7457 52/656.1
6,655,099 B1 * 12/2003 Trenoweth ..... E04B 1/34315 52/522
7,032,426 B2 * 4/2006 Durney ..... B29C 53/063 72/379.2
7,074,474 B2 * 7/2006 Toi ..... B29C 70/443 244/119
7,228,805 B2 * 6/2007 Beers ..... B60P 3/20 105/423
7,356,970 B1 * 4/2008 Frobosilo ..... E04B 1/08 52/261
7,849,640 B2 * 12/2010 Rice ..... E04B 2/7457 33/483
7,877,961 B2 * 2/2011 Strickland ..... E04C 3/294 52/153
7,963,080 B1 * 6/2011 Bowman ..... B32B 27/42 52/309.7
8,074,416 B2 * 12/2011 Andrews ..... E04B 2/767 403/230
8,328,175 B2 * 12/2012 O'Shea ..... A21C 9/08 52/656.1
8,615,969 B2 * 12/2013 Suzuki ..... E04H 9/02 52/800.1
8,636,252 B2 * 1/2014 Pook ..... B29C 65/5057 244/119
8,769,901 B2 * 7/2014 Todd ..... E04B 1/7038 52/302.1
8,997,424 B1 * 4/2015 Miller ..... E04B 1/08 52/656.1
9,091,049 B2 * 7/2015 Walker ..... E04C 2/38
10,024,057 B2 * 7/2018 Gibson ..... E04C 2/46
10,041,288 B1 * 8/2018 Flood ..... E04B 2/58
10,077,553 B2 * 9/2018 Neumayr ..... E04B 1/14
10,407,894 B2 * 9/2019 Strickland ..... E04B 1/2403
10,465,382 B2 * 11/2019 Rice ..... E04B 2/7457
10,808,404 B2 * 10/2020 Castellucci ..... E04B 2/789
10,934,711 B1 * 3/2021 Malinowski ..... E04B 5/10
10,961,710 B2 * 3/2021 Collins ..... E04C 2/521
D925,777 S * 7/2021 Dingle ..... D25/138
11,702,838 B2 * 7/2023 Kralic ..... E04C 2/08 52/783.19
2007/0011971 A1 * 1/2007 Sitkiewicz ..... E04B 2/767 52/481.1
2007/0113512 A1 * 5/2007 Olvera ..... E04C 3/07 52/656.1
2008/0110126 A1 * 5/2008 Howchin ..... E04C 3/32 52/630
2009/0019809 A1 * 1/2009 Kiji ..... B23K 9/18 52/630
2009/0113820 A1 * 5/2009 Deans ..... E04B 1/14 52/800.1
2011/0225911 A1 * 9/2011 Battisti ..... E04B 2/7457 52/302.1
2012/0144774 A1 * 6/2012 Andrews ..... E04B 2/7411 52/656.9
2013/0305643 A1 * 11/2013 Singleton ..... G06F 30/13 52/404.1
2016/0053486 A1 * 2/2016 Agda ..... E04B 2/8652 52/220.8
2022/0205239 A1 * 6/2022 King ..... F16B 2/248

FOREIGN PATENT DOCUMENTS

EP 192295 A * 8/1986 ..... B21D 47/04
WO WO-2007102830 A1 * 9/2007 ..... E04B 1/161

* cited by examiner

STIFF WALL PANEL ASSEMBLY FOR A BUILDING STRUCTURE AND ASSOCIATED METHOD(S)

CROSS REFERENCE TO RELATED APPLICATIONS

This is a U.S. continuation-in-part application that claims priority to and benefit of currently pending U.S. non-provisional patent application Ser. No. 18/190,092, filed Mar. 26, 2023, which claims priority to and benefit of U.S. non-provisional patent application Ser. No. 18/055,448, filed Nov. 15, 2022, now U.S. Pat. No. 11,643,818, which claims priority to and benefit of U.S. provisional patent application No. 63/368,450 filed Jul. 14, 2022, which are incorporated by reference herein in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to wall panel assemblies and, more particularly, to a specially configured modular steel stiff wall panel assembly for providing improved resistance to shear forces, racking forces, and impact forces.

Prior Art

Stick frame construction or simply stick construction is used for a large portion of the frame of a building, is used in a large percentage of smaller scale building construction projects. Stick construction utilizes studs, lightweight materials, typically either wood or metal, to construct the frame, including walls, floor joists and roof trusses of the building under construction, wood studs being typical in residential construction and metal studs being typical in commercial construction. Stick frame construction produces a building frame that has a relatively high strength to weight ratio.

While a strong frame can be produced using standard stick frame construction, there is room for improvement. One issue building design engineers grapple with is trying to increase the shear strength of the frame built, especially, the vertical or wall components of the frame. A stick frame constructed building is subject to in plane lateral forces, caused by wind and earthquakes. If such in plane force is sufficiently strong, the building can be subject to racking, wherein the walls of the building come out of square. Racking causes damage to carious components of the building, including the walls, both interior and exterior, cabinets, doors and windows, flooring, especially upper story flooring, and in extreme cases, structural failure.

In wood stick frame construction, engineers focus on the strength of the wood used to produce the stud as well as bracing the frame and the walls via sheathing and other methods, in order to increase the shear strength of the structure built in order to thereby reduce the potential for racking. In addition to these considerations, in metal stick construction, engineers also focus on the geometry of the frame, particularly the stud, to increase the overall shear strength of the stud and thereby increase overall shear strength of the frame produced.

Accordingly, a need remains for a modular stiff wall panel assembly in order to overcome at least one of the above-noted shortcomings. The exemplary embodiment(s) satisfy such a need by a specially configured modular stiff wall panel assembly that is convenient and easy to use, lightweight yet durable in design, versatile in its applications, and designed for providing improved resistance to shear forces, racking forces, and impact forces

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured modular stiff wall panel assembly for providing improved resistance to shear forces, racking forces, and impact forces. These and other objects, features, and advantages of the non-limiting exemplary embodiment(s) are provided by a stiff wall panel assembly for a building structure, including a modular wall panel including a body having a single, continuous, and unitary layer extended along an entire surface area of the wall panel; a plurality of studs statically engaged with the single, continuous, and unitary layer; a plurality of external reinforcement members statically engaged with the single, continuous, and unitary layer; and a plurality of internal reinforcement members statically engaged with the studs and oppositely spaced from the external reinforcement members; wherein each of the external reinforcement members and the internal reinforcement members have a hat-shaped cross-section (profile).

In a non-limiting exemplary embodiment, the single, continuous, and unitary layer includes a central portion, and a bottom wall track engaged with the central portion and having a plurality of bottom ribs spaced therealong. Notably, the studs are engaged with the central portion and the bottom wall track. Advantageously, the external reinforcement members are engaged with the central portion.

In a non-limiting exemplary embodiment, each of the external reinforcement members and the internal reinforcement members includes a first side and a second side converging laterally away therefrom, and a central side having axially opposed edges directly and integrally attached to each of the first side and the second side. Advantageously, the central side defines an apex of each the external reinforcement members and the internal reinforcement members. Advantageously, the central side is rectilinear and planar.

In a non-limiting exemplary embodiment, each of the external reinforcement members and the internal reinforcement members further includes a fifth side integrally connected to the first side and extended laterally away therefrom, and a sixth side integrally connected to the second side and extended laterally away therefrom in a direction opposite to the fifth side. Advantageously, both of the fifth side and the sixth side are rectilinear and coplanar.

In a non-limiting exemplary embodiment, each stud includes at least one stiffener that linearly extends along an entire longitudinal length of the associated stud. Advantageously, the central side is intercalated between the first side and the second side such that the first side is equidistantly offset from the second side.

In a non-limiting exemplary embodiment, the external reinforcement members and the internal reinforcement members are linearly aligned, respectively, and registered orthogonal to a longitudinal axis of the studs, respectively. Advantageously, the external reinforcement members and the internal reinforcement members are located on two separate vertical planes, respectively, and oppositely disposed such that the central portion and the studs are intercalated between the internal reinforcement members and the external reinforcement members.

In a non-limiting exemplary embodiment, each of a longitudinal length of the wall panel and a longitudinal axis of the studs is oriented orthogonal to a horizontal ground surface.

In a non-limiting exemplary embodiment, each of the external reinforcement members and the internal reinforcement members has an associated longitudinal length oriented parallel to a horizontal ground surface.

In a non-limiting exemplary embodiment, the external reinforcement members are equidistantly spaced along the central portion and registered orthogonal to a longitudinal axis of the central portion.

In a non-limiting exemplary embodiment, the bottom ribs are registered orthogonal to a longitudinal axis of the bottom wall track.

In a non-limiting exemplary embodiment, the internal reinforcement members are registered orthogonal to a longitudinal axis of the bottom wall track.

In a non-limiting exemplary embodiment, the external reinforcement members are integral with the central portion and linearly parallel to a latitudinal axis thereof.

In a non-limiting exemplary embodiment, the external reinforcement members are orthogonal to the bottom ribs.

In a non-limiting exemplary embodiment, the external reinforcement members, the bottom ribs, and the internal reinforcement members are linearly disposed along an associated unique plane.

In a non-limiting exemplary embodiment, each of the bottom ribs, the internal reinforcement members, and the external reinforcement members are rectilinear.

In a non-limiting exemplary embodiment, the central portion is removably attached to the studs.

In a non-limiting exemplary embodiment, the bottom wall track has a single stiffening lip longitudinally extended orthogonal to the studs and oppositely spaced from the central portion. Advantageously, the bottom ribs are integral with the single stiffening lip.

In a non-limiting exemplary embodiment, the central portion is integral with the bottom wall track.

In a non-limiting exemplary embodiment, the bottom wall track includes a base integral with the first stiffening lip and oriented perpendicular thereto. Advantageously, the base is integral with the central portion, and a bottom end of each of the studs is intercalated between the central portion and the first stiffening lip.

In a non-limiting exemplary embodiment, the external reinforcement members begin and terminate at the central portion; wherein the bottom ribs begin and terminate at the bottom wall track.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 36:
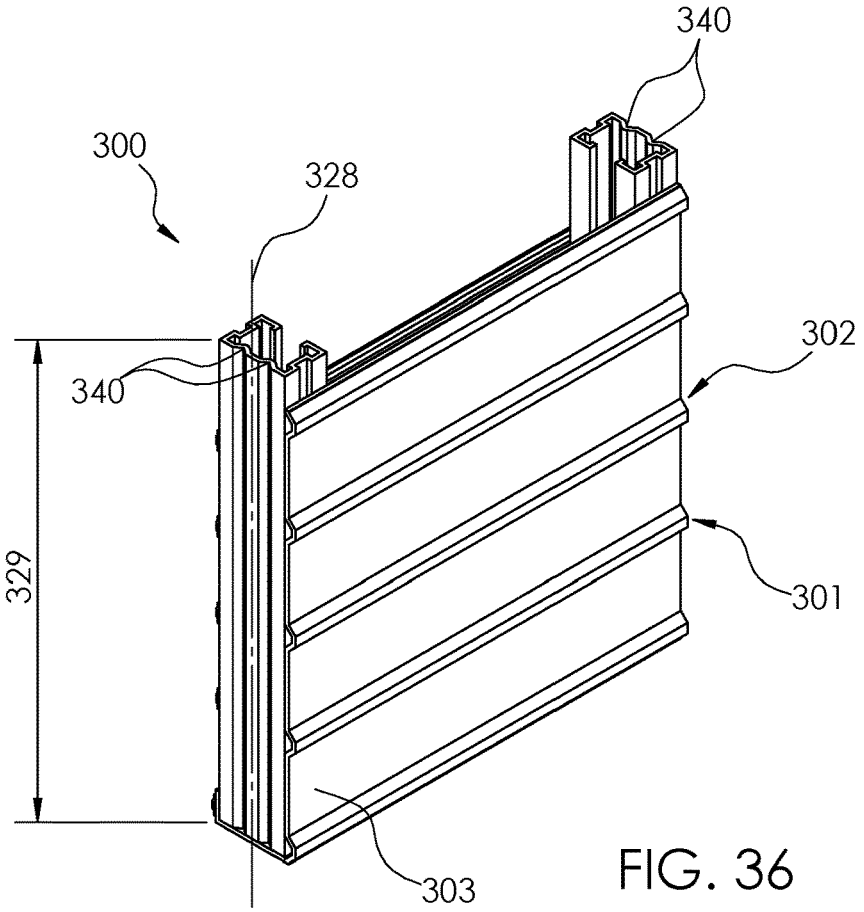
FIG. 36 is a perspective view of another modular stiff wall panel assembly having a plurality external and internal reinforcement members used in combination with studs, in accordance with a non-limiting exemplary embodiment of the present disclosure.
Figure 37:
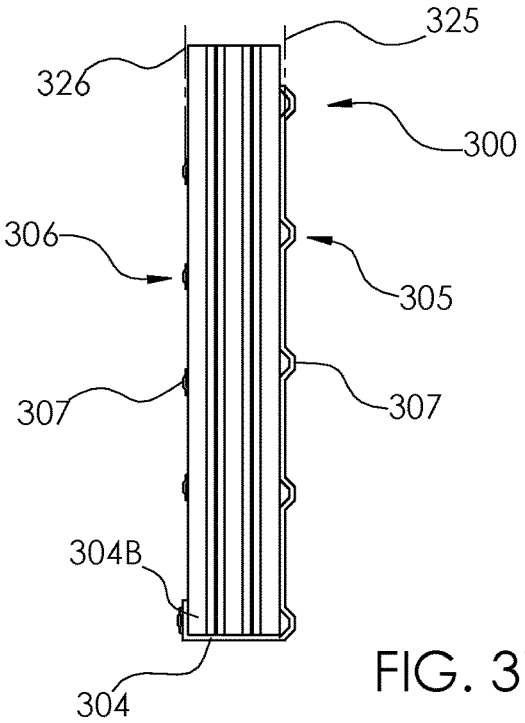
FIG. 37 is a side elevational view of the modular stiff wall panel assembly shown in FIG. 36, in accordance with a non-limiting exemplary embodiment of the present disclosure.
Figure 38:
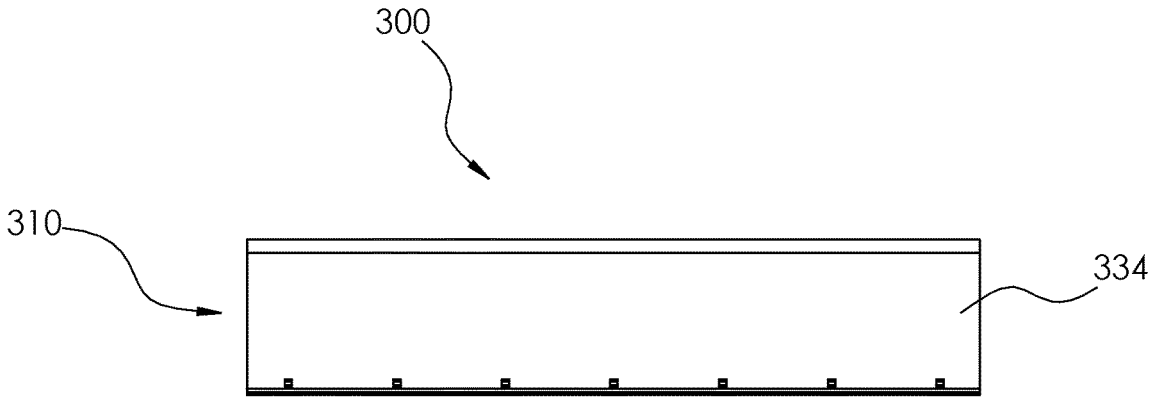
FIG. 38 is a bottom plan view of the modular stiff wall panel assembly shown in FIG. 36, in accordance with a non-limiting exemplary embodiment of the present disclosure.
Figure 39:
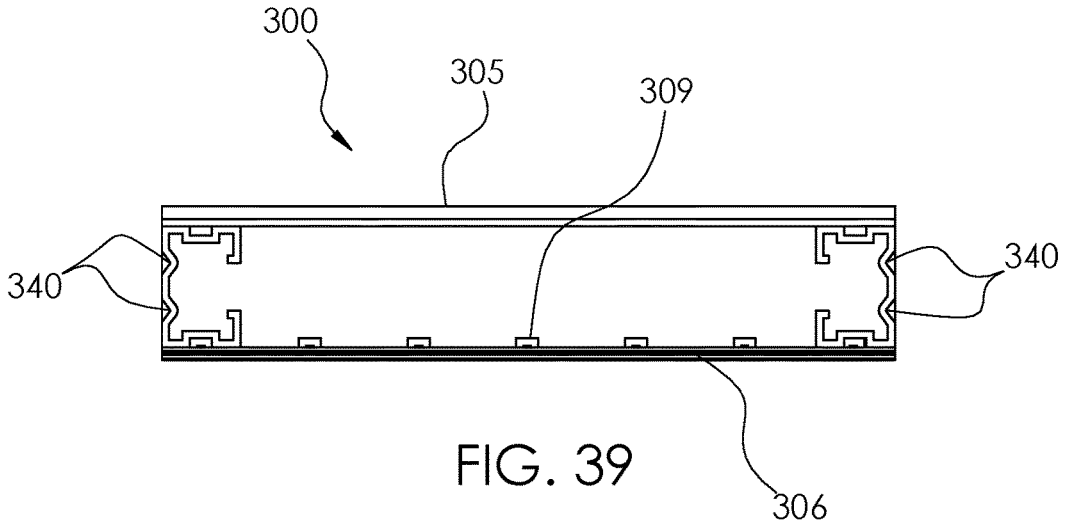
FIG. 39 is a top plan view of the modular stiff wall panel assembly shown in FIG. 36, in accordance with a non-limiting exemplary embodiment of the present disclosure.
Figure 40:
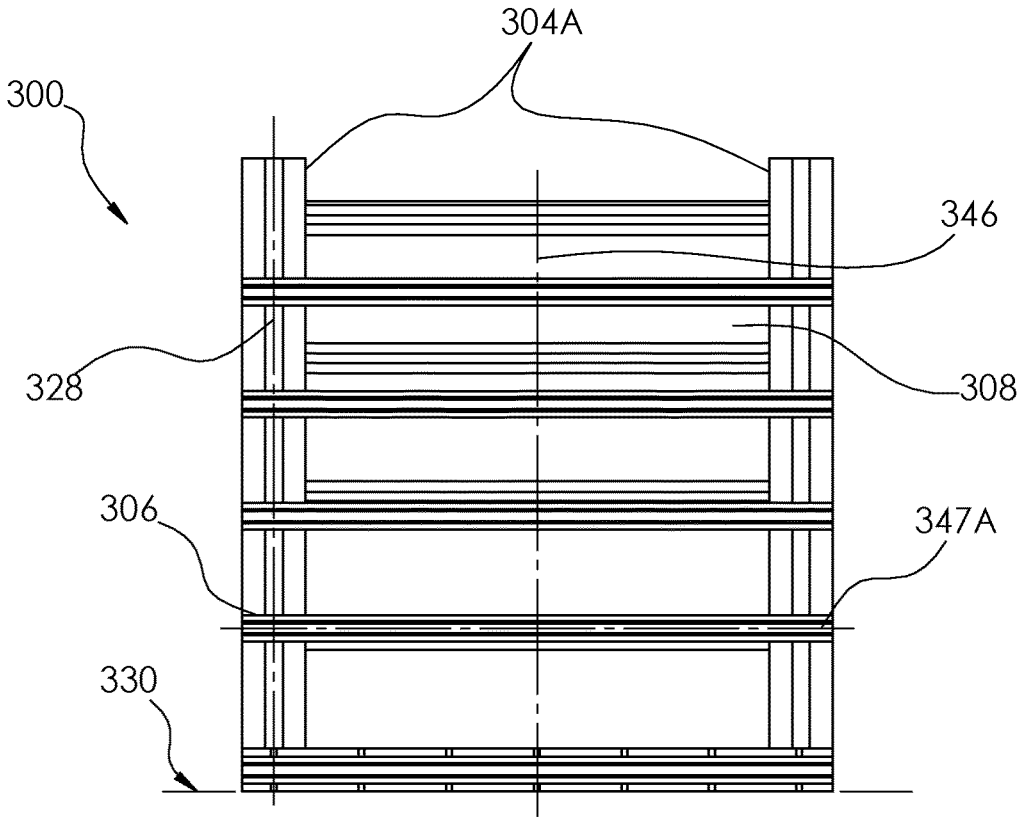
FIG. 40 is a front elevational (interior) view of the modular stiff wall panel assembly shown in FIG. 36, in accordance with a non-limiting exemplary embodiment of the present disclosure.
Figure 41:
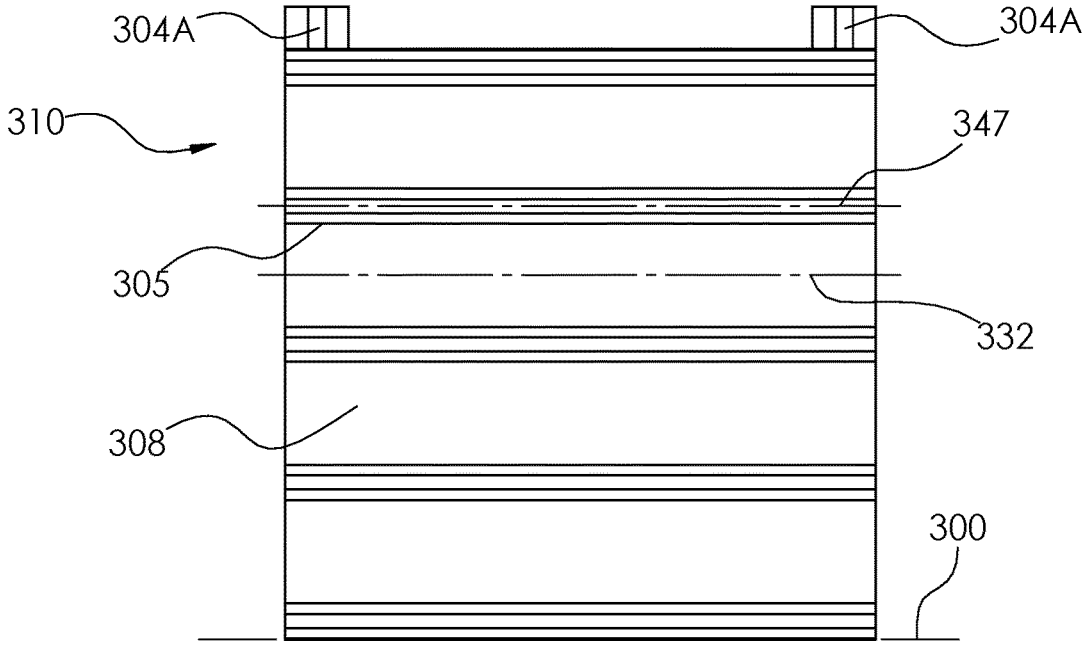
FIG. 41 is a rear elevational (exterior) view of the modular stiff wall panel assembly shown in FIG. 36, in accordance with a non-limiting exemplary embodiment of the present disclosure.
Figure 42:
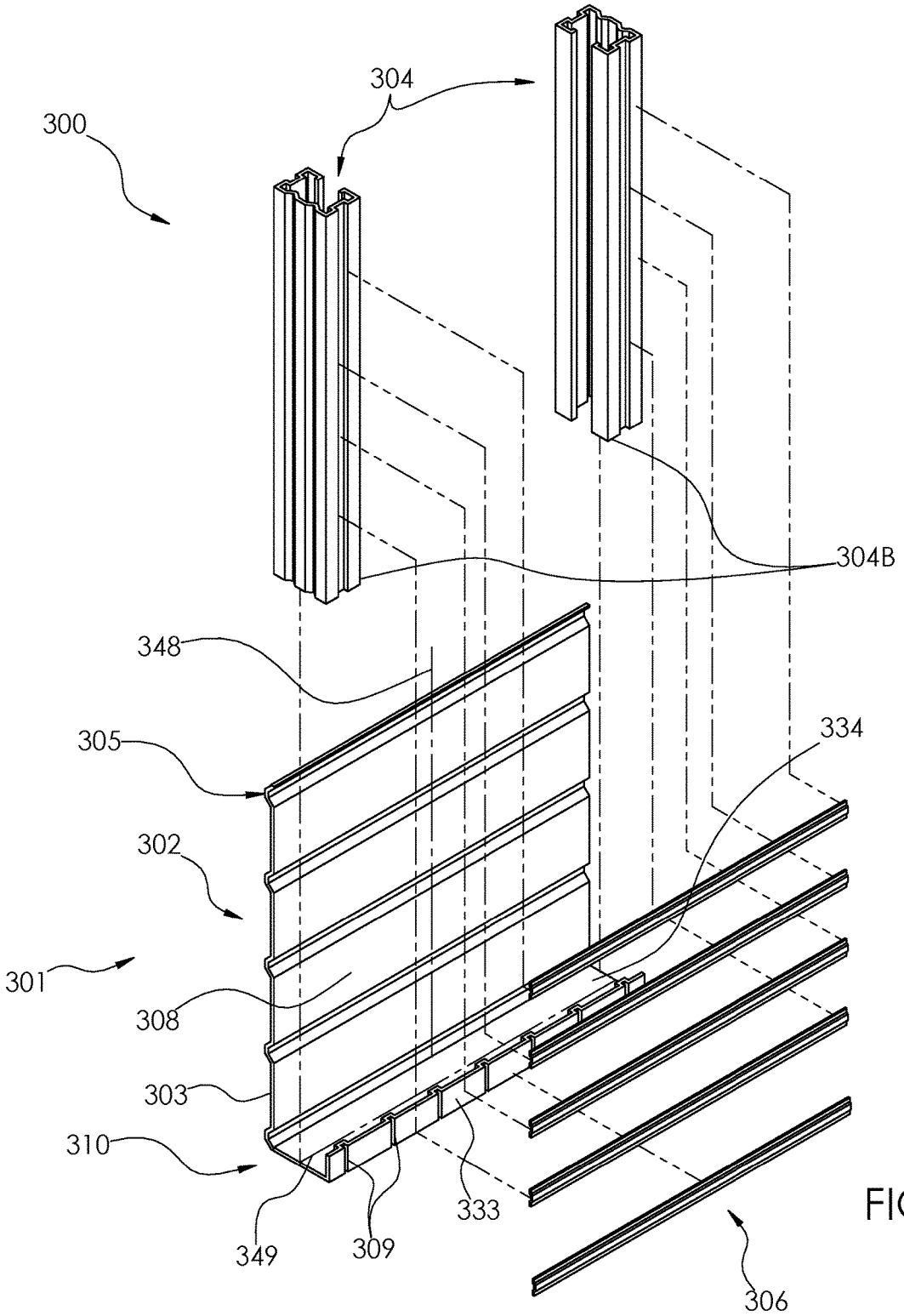
Figure 43:
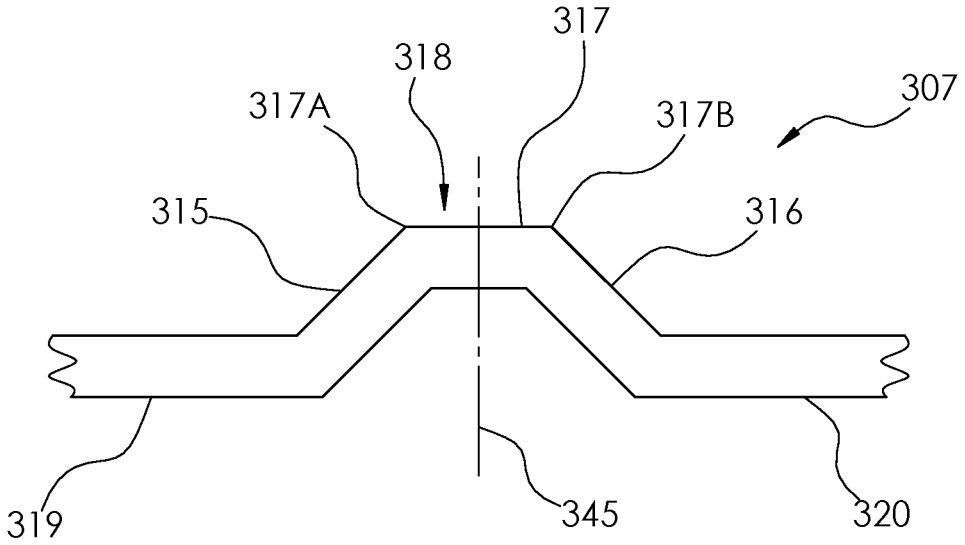

FIG. 42 is an exploded view of the modular stiff wall panel assembly shown in FIG. 36, in accordance with a non-limiting exemplary embodiment of the present disclosure; and FIG. 43 is an enlarged, partial side elevational view illustrating a profile (and cross-section) of the external and internal reinforcement members, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s) Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational and are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

A non-limiting exemplary embodiment(s) of the present disclosure is referred to generally in the figures and is intended to provide a specially configured steel stiff wall panel assembly for providing improved resistance to shear forces, racking forces, and impact forces. It should be understood that the exemplary embodiment(s) may be used to erect many building structures, and should not be limited to any particular building structure described herein.

The non-limiting exemplary embodiment(s) is/are referred to generally in FIGS. 1-43 and is/are intended to provide a stiff wall panel assembly 30 provides an exterior sheathing 31 substrate on walls and roofs. The stiff wall panel assembly 30 is installed on the exterior face of the wall framing and or roof framing. Additional building/finish materials (e.g., sheathing 31) are then installed over the stiff wall panel assembly 30. Benefits provided by the properties of the stiff wall panel assembly 30 are: impact resistant (missile projection); resists high wind forces; provides lateral stability of the structure; conceals fasteners (eliminates fastener head projection so as not to interfere with finish materials); and provides additional vertical strength to wall assemblies which in turn allows for flexibility in framing layout.

FIGS. 1-27 disclose various embodiments of a stiff wall panel assembly 30 for a building structure. The stiff wall panel assembly 30 includes a wall panel 32 including a single, continuous, and unitary layer 33 extended along an entire surface area of the wall panel 32. Such a single, continuous, and unitary layer 33 includes a central portion 34 having a plurality of central ribs 35 spaced therealong, a first wall track 36 engaged with the central portion 34 and having a plurality of first ribs 37 spaced therealong, and a second wall track 38 engaged with the central portion 34 and having a plurality of second ribs 39 spaced therealong. A plurality of studs 40 are engaged with the central portion 34, the first wall track 36, and the second wall track 38. Such studs 40 have a plurality of third ribs 41 each engaged with the central ribs 35, the first ribs 37, and the second ribs 39. Advantageously, the first ribs 37 and the second ribs 39 each are linearly interlocked as well as linearly and slidably interfitted within the third ribs 41 of the studs 40. Advantageously, the first ribs 37 and the second ribs 39 each are parallel to the third ribs 41 of the studs 40. Notably, the first ribs 37 and the second ribs 39 each having a longitudinal length shorter than a longitudinal length of the third ribs 41 of the studs 40. Such a structural configuration yields the new, useful, and unpredicted result of improved resistance to shear forces, racking forces, and impact forces.

In a non-limiting exemplary embodiment, the first wall track 36 is oriented parallel to the second wall track 38. Such a structural configuration yields the new, useful, and unpredicted result of improved resistance to shear forces, racking forces, and impact forces.

In a non-limiting exemplary embodiment, the central ribs 35 are integral with the central portion 34 and linearly extended therealong. Such a structural configuration yields the new, useful, and unpredicted result of improved resistance to shear forces, racking forces, and impact forces.

In a non-limiting exemplary embodiment, the central ribs 35 are parallel to the first ribs 37, the second ribs 39, and the third ribs 41. Such a structural configuration yields the new, useful, and unpredicted result of improved resistance to shear forces, racking forces, and impact forces.

In a non-limiting exemplary embodiment, the central ribs 35 are linearly interlocked as well as linearly and slidably interfitted with the third ribs 41 of the studs 40. Such a structural configuration yields the new, useful, and unpredicted result of improved resistance to shear forces, racking forces, and impact forces.

In a non-limiting exemplary embodiment, the central ribs 35 are orthogonal to the first ribs 37, the second ribs 39, and the third ribs 41. Such a structural configuration yields the new, useful, and unpredicted result of improved resistance to shear forces, racking forces, and impact forces.

In a non-limiting exemplary embodiment, a plurality of fasteners 42 connected to a plurality of intersecting junctures 43 of the central ribs 35 and the third ribs 41 of the studs 40, respectively. Such a structural configuration yields the new, useful, and unpredicted result of improved resistance to shear forces, racking forces, and impact forces.

In a non-limiting exemplary embodiment, the central portion 34 is integral and monolithic with the first wall track 36 and the second wall track 38. Such a structural configuration yields the new, useful, and unpredicted result of improved resistance to shear forces, racking forces, and impact forces.

In a non-limiting exemplary embodiment, each of the first wall track 36 and the second wall track 38 has a single stiffening lip 44 longitudinally extended orthogonal to the studs 40 and oppositely spaced from the central portion 34. Advantageously, the first ribs 37 and the second ribs 39 are located at the single stiffening lip 44, respectively. Such a structural configuration yields the new, useful, and unpredicted result of improved resistance to shear forces, racking forces, and impact forces.

In a non-limiting exemplary embodiment, the central portion 34 is separate from and detachably coupled to each of the first wall track 36 and the second wall track 38. Such a structural configuration yields the new, useful, and unpredicted result of improved resistance to shear forces, racking forces, and impact forces.

In a non-limiting exemplary embodiment, the central portion 34 has a first tongue 45 and a second tongue 46 located at opposed perimeter edges of the central portion 34. Advantageously, each of the first tongue 45 and the second tongue 46 is rectilinear and parallel to the central ribs 35, respectively. Such a structural configuration yields the new, useful, and unpredicted result of improved resistance to shear forces, racking forces, and impact forces.

In a non-limiting exemplary embodiment, each of the first wall track 36 and the second wall track 38 has a pair of stiffening lips 47, 48 longitudinally extended orthogonal to the studs 40. Advantageously, a first one of the stiffening lips 47 is directly connected to the central wall panel 32 and a second one of the stiffening lips 48 is oppositely spaced from the central wall panel 32. In this manner, the first ribs 37 of the first wall track 36 and the second ribs 39 of the second wall track 38 are located at the first one 47 and the second one 48 of the stiffening lips associated with each of the first wall track 36 and the second wall track 38, respectively. Such a structural configuration yields the new, useful, and unpredicted result of improved resistance to shear forces, racking forces, and impact forces.

In a non-limiting exemplary embodiment, the stiff wall panel assembly 30 is constructed of various metal gauges (ideal range 22 to 20 gauge). Repetitive grooves (ribs 35) are rolled or bent in the material to provide rigidity and act as a fastening flange. The sides of the wall panel 32 are laid out to overlap with adjacent panels on all four sides.

In a non-limiting exemplary embodiment, the stiff wall panel assembly 30 includes a "built-in" top 36 and bottom track 38 which accepts vertical studs 40 (framing members).

In a non-limiting exemplary embodiment, the stiff wall panel assembly 30 includes individual top 36 and bottom tracks 38 which mate with a standard stiff panel sheet 32.

Referring to the FIGS. 1-27, in a non-limiting exemplary embodiment(s), the present disclosure provides the following new, useful, and unexpected benefits: track is built into panels and laid out with "S" ribs; added shear 300-400% more than plywood; non-combustible; impact resistant; greater pullout strength for sidings and finish (e.g., nail pulled out from wood panel requires about 80 lbs. Nail pulled out from steel panel 32 requires about 250-350 lbs.); seismic and wind rated for over 200 mph; bearing capacity is up to 2000 lbs loads between studs 40 and loading over studs 40 can be 8000-45,000 lbs by changing a gauge of the wall stud 40; uplift attachment plates/clips provide ten times more capacity than a screw or standard clip; cost effective; less labor; and recessed screws.

The present disclosure further provides the following additional new, useful, and unexpected benefits: impact resistant; non-combustible; shear panel; increased racking force; pre-layouts; recessed screw attachments; horizontal rib panel thermal break; increased load capacity in between studs 40; and increased capability by adding additional fasteners 42.

In a non-limiting exemplary embodiment, the present disclosure includes horizontal 0.5 inch deep ribs 35 running across the wall panel 32 with ribs 37, 39 on top and bottom lips of tracks 36, 38.

In a non-limiting exemplary embodiment, the present disclosure includes stud ribs 41 running down the wall panel 32 for flush panel.

The stiff wall panel assembly 30 includes a wall panel 32 having a centrally registered longitudinal axis and including a single, continuous, and unitary layer 33 extended along an entire surface area of the wall panel 32. Such a single, continuous, and unitary layer 33 includes a central portion 34, a first wall track 36 axially and a second wall track 38 axially opposed therefrom. The first wall track 36 and the second wall track 38 are axially offset along the centrally registered longitudinal axis and monolithically connected to the central portion 34, and a plurality of ribs 35 juxtaposed and spaced apart along the wall panel 32. Advantageously, the ribs are integral with the central portion 34 and linearly extended therealong. Notably, the first wall track 36 and the second wall track 38 are non-planar relative to the central portion 34.

In a non-limiting exemplary embodiment, the present disclosure further includes a plurality of wall studs 40 statically affixed to the wall panel 32 and statically engaged with the ribs 37, 39, a floor beam may be statically connected to the second wall track 38, a plurality of floor joists may be positioned on an existing support surface and engaged with the wall panel 32 and the floor beam, and a plurality of fasteners 42 engaged with the wall panel 32, the wall studs 40, and the floor beam, and the floor joists.

In a non-limiting exemplary embodiment, the single, continuous, and unitary layer 33 further includes a linear left edge and a linear right edge each extended along the central portion 34 and equidistantly offset from the central registered longitudinal axis.

In a non-limiting exemplary embodiment, the central portion 34 includes a plurality of planar sections **34*a* intercalated between the plurality of ribs 35 and extended along an entire longitudinal length of the ribs 35**.

In a non-limiting exemplary embodiment, the wall studs 40 are statically engaged directly with the central portion 34, the first wall track 36, and the second wall track 38.

In a non-limiting exemplary embodiment, the ribs 35 protrude outwardly from an anterior face of the central portion 34.

In a non-limiting exemplary embodiment, the ribs 35 are equidistantly spaced apart.

In a non-limiting exemplary embodiment, the first wall track 36 and the second wall track 38 are integral and monolithically connected to the central portion 34.

In a non-limiting exemplary embodiment, the single, continuous, and unitary layer 33 consists of a single sheet of steel.

In a non-limiting exemplary embodiment, the wall studs 40 include a single, continuous, and unitary body including a single sheet of steel.

In a non-limiting exemplary embodiment, the ribs 35 are coextensively shaped and oriented perpendicular to the first wall track 36 and the second wall track 38.

In a non-limiting exemplary embodiment, the ribs 35 are coextensively shaped and oriented parallel to the first wall track 36 and the second wall track 38. Such ribs 35 are extended from the first wall track 36 to the second wall track 38.

In a non-limiting exemplary embodiment, each of the first wall track 36 and the second wall track 38 are L-shaped or U-shaped.

In a non-limiting exemplary embodiment, a depth of each of the first wall track 36 and the second wall track 38 is equal to a depth of the wall studs 40.

In a non-limiting exemplary embodiment, a latitudinal width of the central portion 34 is equal to a longitudinal length of the floor beam.

In a non-limiting exemplary embodiment, the ribs 35 span across an entire latitudinal width of the wall panel 32.

In a non-limiting exemplary embodiment, the wall studs 40 have axially opposed ends directly connected to the first wall track 36 and the second wall track 38.

In a non-limiting exemplary embodiment, the wall studs 40 are directly and statically affixed to the ribs 35 via the fasteners 42.

In a non-limiting exemplary embodiment, the ribs 35 are spaced apart approximately six to sixteen inches or twenty-four inches apart.

Referring to FIGS. 28-35, in a non-limiting exemplary embodiment(s), a modular stiff wall panel assembly 100 for a building structure is disclosed. Advantageously, the assembly 100 will be totally supported by at least one wall track (e.g., first wall track 107 and/or second wall track 109). In minutes, the modular stiff wall panel assembly 100 is completely laid out and then the studs 120 are fastened in place at the (bottom wall track) second wall track 109. Pop on the first wall track 107 (top wall track) to lock in the other ends of the studs 120. An entire building's walls can be erected in less time and with fewer installers and materials. The top wall track 109 also can be the same or heavier gauge as the bottom wall track 107 to act as a header along with lateral shear. The central portion 105 can be lighter or heavier gauge relative to the first wall track 107 and second wall track 109, for economy or structural integrity.

Advantageously, the modular stiff wall panel assembly 100 is constructed from the bottom wall track (second wall track 109) and supported with studs 120 up to a top of the assembly 100, which has a header (top wall track) first wall track 107. As noted above, one or more central portions 105 may have various gauges to fill in remaining spaces. Advantageously, a return lip (single stiffening lip 107*a*) on first wall track 107 may be between 3-6 inches tall. Such a single stiffening lip 107*a* provides added strength so that additional axial load can be increased. The second wall track 109 (bottom wall track) also has a return lip (single stiffening lip 109*a*) that may be about 2 inches tall.

Such a modular stiff wall panel assembly 100 includes a modular wall panel 101 having a body 102 provided with a plurality of single, continuous, and unitary layers 103 extended along an entire surface area of the modular wall panel 101. The plurality of single, continuous, and unitary layers 103 include a central portion 105 having a plurality of central ribs 106 spaced therealong, a first wall track 107 engaged with the central portion 105 and having a plurality of first ribs 108 spaced therealong, and a second wall track 109 engaged with the central portion 105 and having a plurality of second ribs 110 spaced therealong (wherein the second wall track 109 is oppositely spaced from the first wall track 107) and a plurality of studs 120 engaged with the central portion 105, the first wall track 107, and the second wall track 109. Advantageously, the central ribs 106, the first ribs 108, and the second ribs 110 are linearly aligned, respectively, and registered parallel to a longitudinal axis 120*a* of the studs 120, respectively. Advantageously, the central ribs 106, the first ribs 108, and the second ribs 110 are coplanar on a single plane 115 and disposed at an end-to-end pattern along an entire longitudinal length 101*a* of the modular wall panel 101. Such a structural configuration yields the new, useful, and unexpected results of reducing material, labor, and time to erect the modular stiff wall panel assembly 100.

Figure 1:
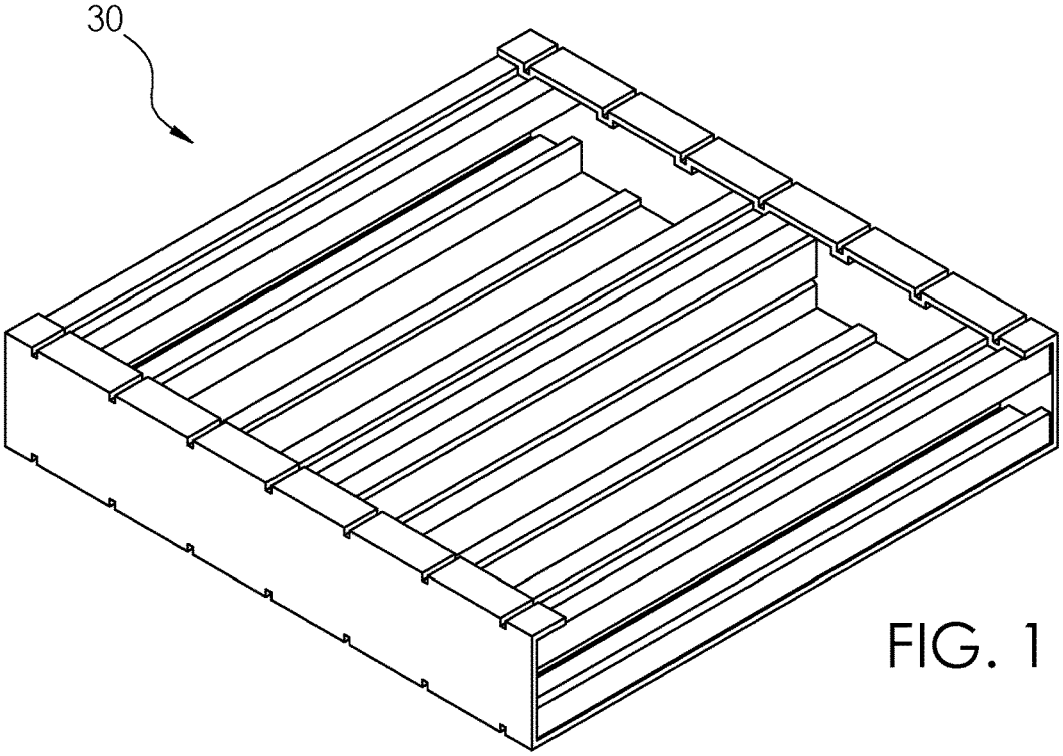
FIG. 1 is a perspective view of a stiff wall panel assembly wherein the wall panel is detachable form the tracks, each having ribs parallel to the studs, in accordance with a non-limiting exemplary embodiment of the present disclosure.
Figure 2:
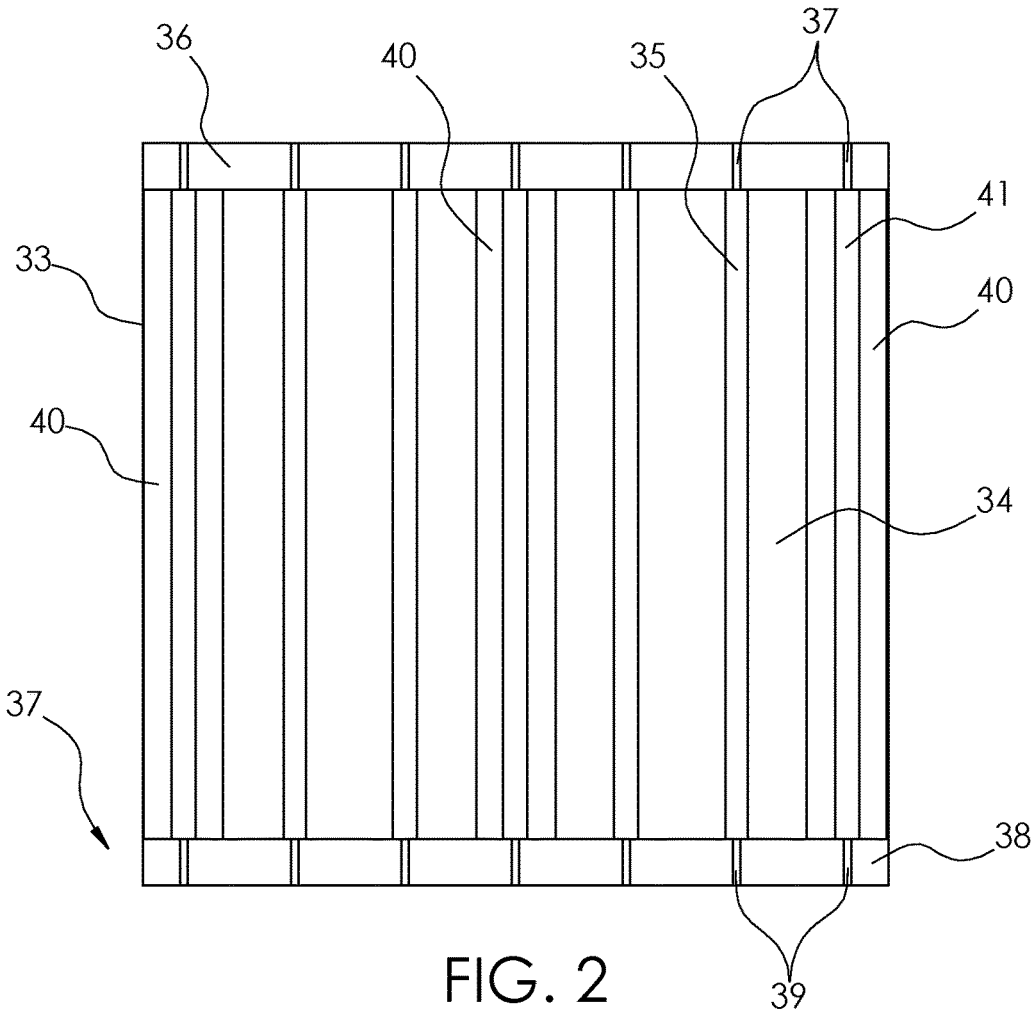
FIG. 2 is a rear elevational view of the stiff wall panel assembly shown in FIG. 1, in accordance with a non-limiting exemplary embodiment of the present disclosure.
Figure 3:
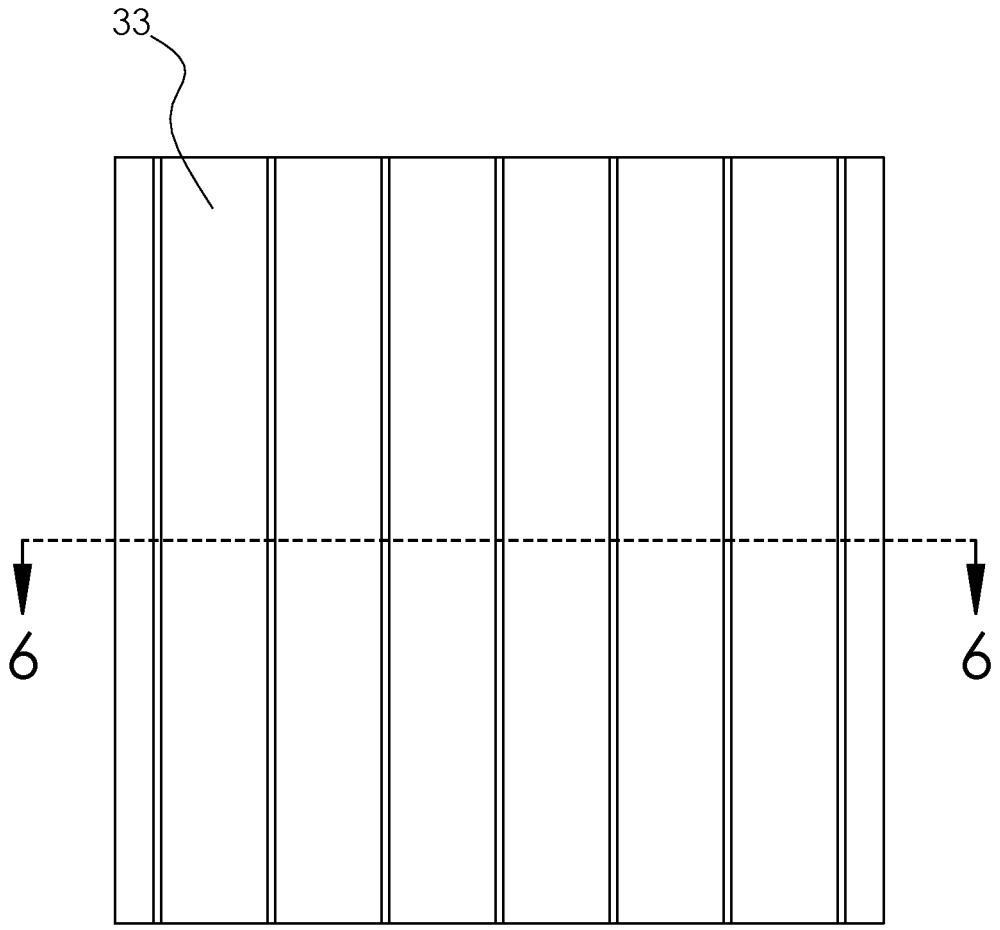
FIG. 3 is a front elevational view of the stiff wall panel assembly shown in FIG. 1, in accordance with a non-limiting exemplary embodiment of the present disclosure.
Figure 4:
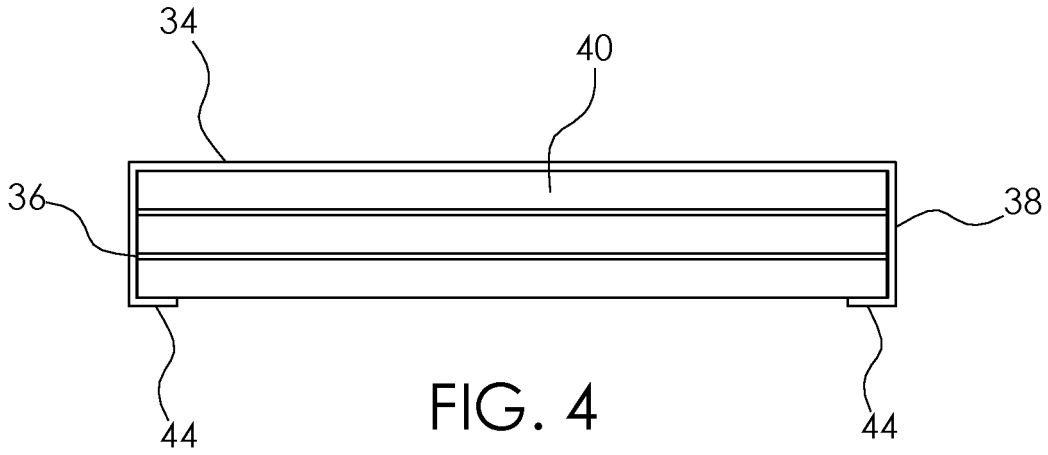
FIG. 4 is a side elevational view of the stiff wall panel assembly shown in FIG. 1, in accordance with a non-limiting exemplary embodiment of the present disclosure.
Figure 5:
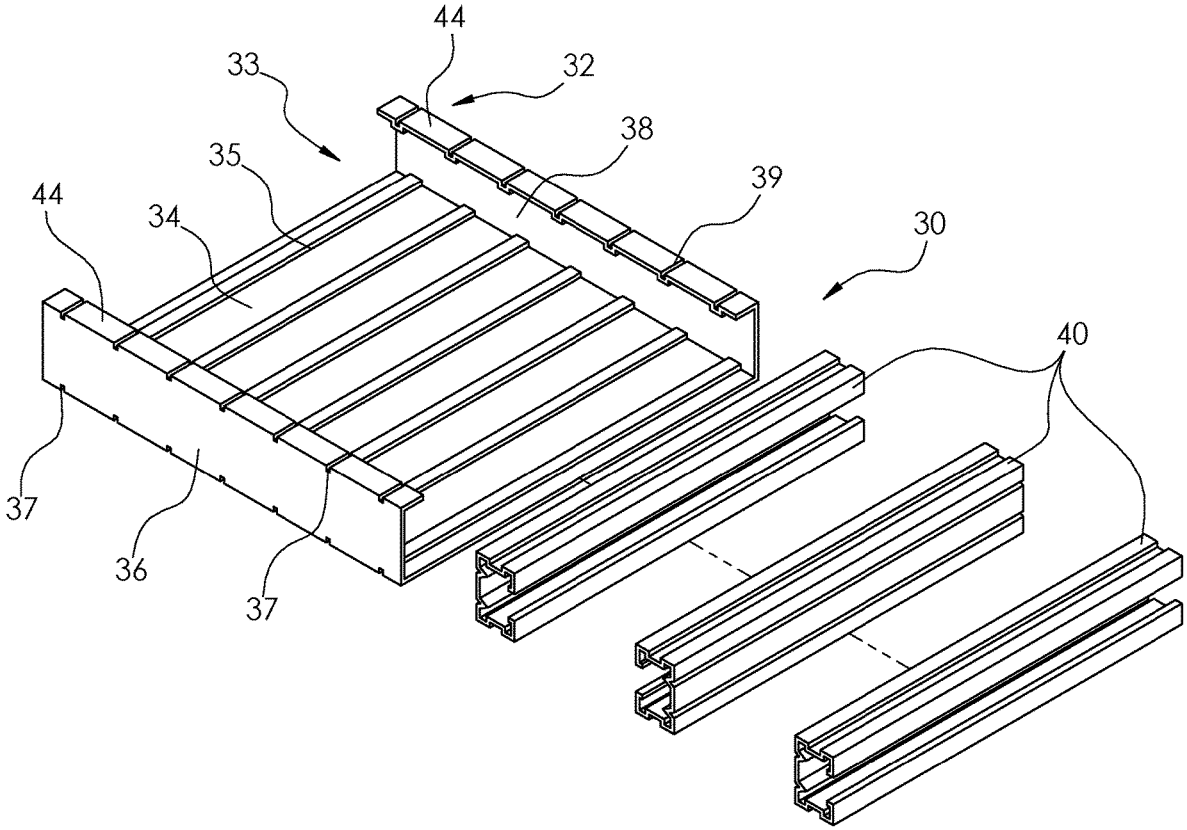
FIG. 5 is an exploded view of the stiff wall panel assembly shown in FIG. 1, in accordance with a non-limiting exemplary embodiment of the present disclosure.
Figure 6:
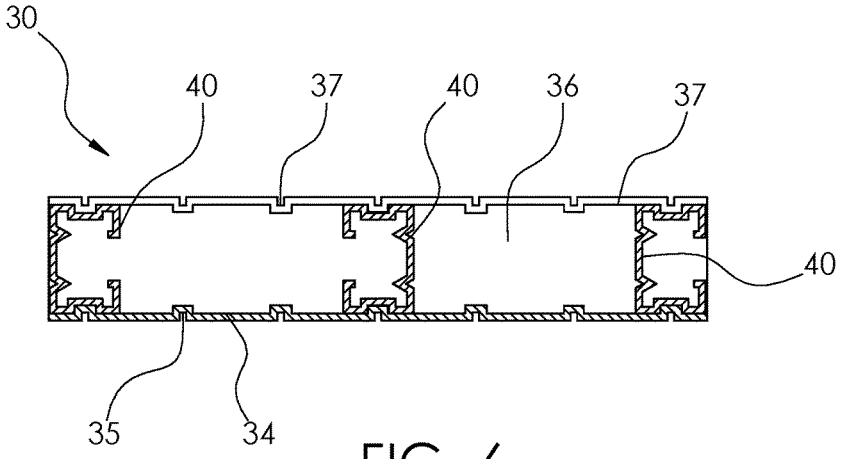
FIG. 6 is a cross-sectional view taken along line 6-6 in FIG. 3, in accordance with a non-limiting exemplary embodiment of the present disclosure.
Figure 7:
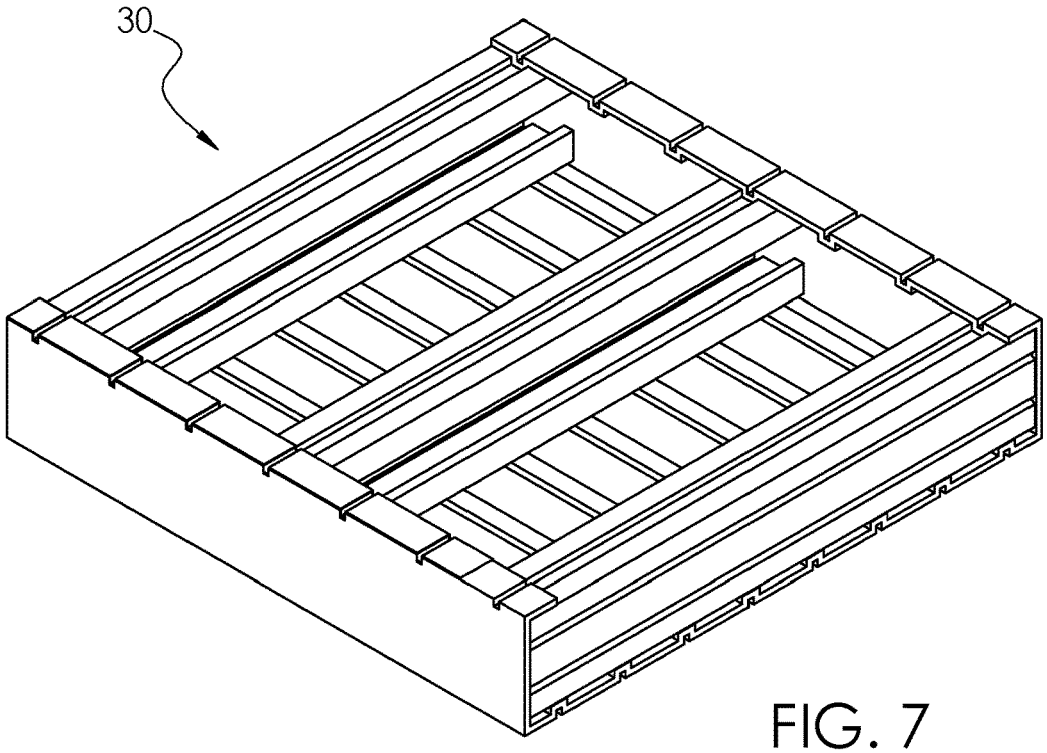
FIG. 7 is a perspective view of a stiff wall panel assembly wherein the wall panel is detachable from the tracks, each having ribs orthogonal and parallel to the studs, respectively, in accordance with a non-limiting exemplary embodiment of the present disclosure.
Figure 8:
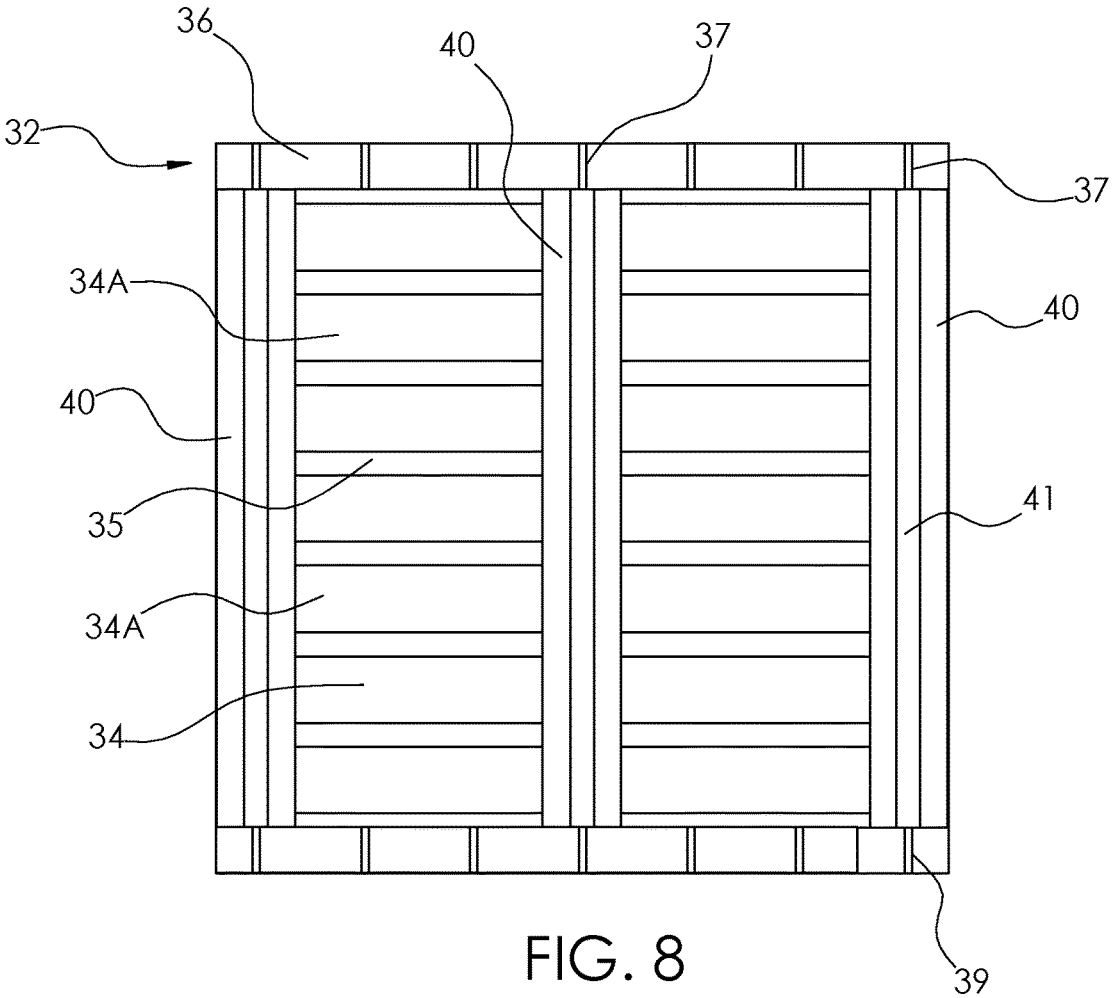
FIG. 8 is a rear elevational view of the stiff wall panel assembly shown in FIG. 7, in accordance with a non-limiting exemplary embodiment of the present disclosure.
Figure 9:
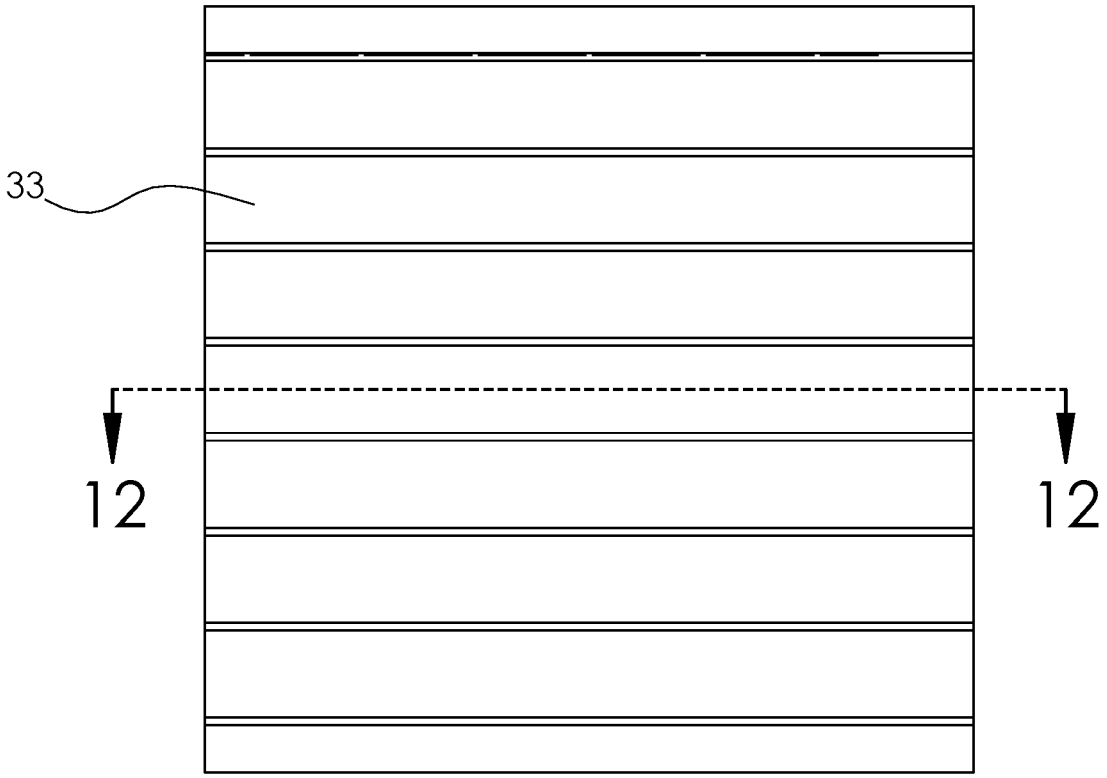
FIG. 9 is a front elevational view of the stiff wall panel assembly shown in FIG. 7, in accordance with a non-limiting exemplary embodiment of the present disclosure.
Figure 10:
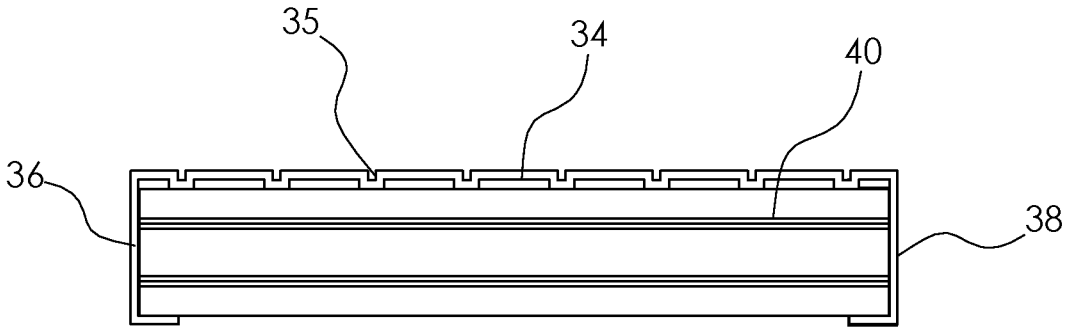
FIG. 10 is a side elevational view of the stiff wall panel assembly shown in FIG. 7, in accordance with a non-limiting exemplary embodiment of the present disclosure.
Figure 11:
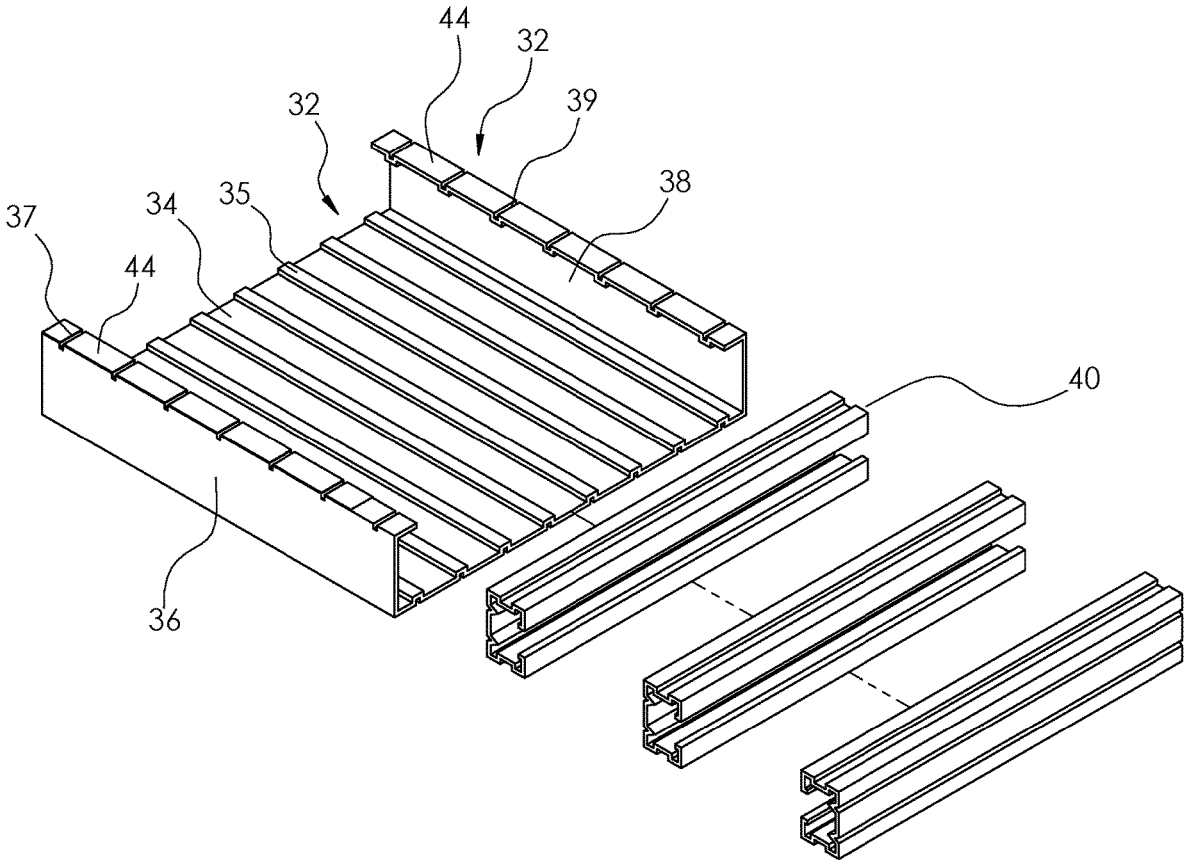
FIG. 11 is an exploded view of the stiff wall panel assembly shown in FIG. 7, in accordance with a non-limiting exemplary embodiment of the present disclosure.
Figure 12:
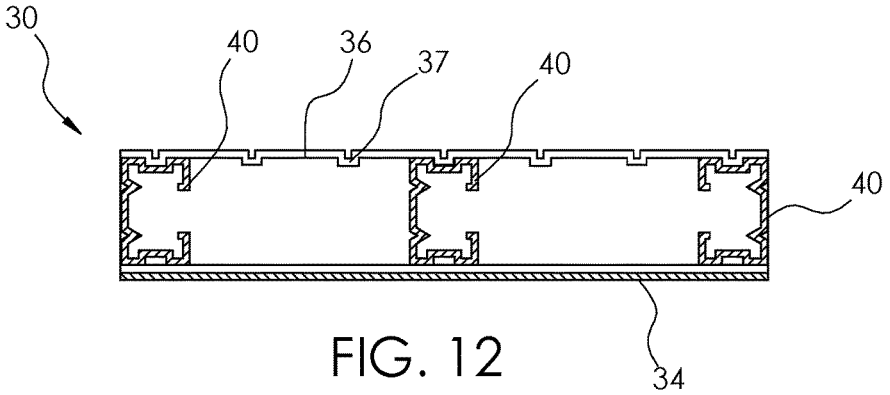
FIG. 12 is a cross-sectional view taken along line 12-12 in FIG. 9, in accordance with a non-limiting exemplary embodiment of the present disclosure.
Figure 13:
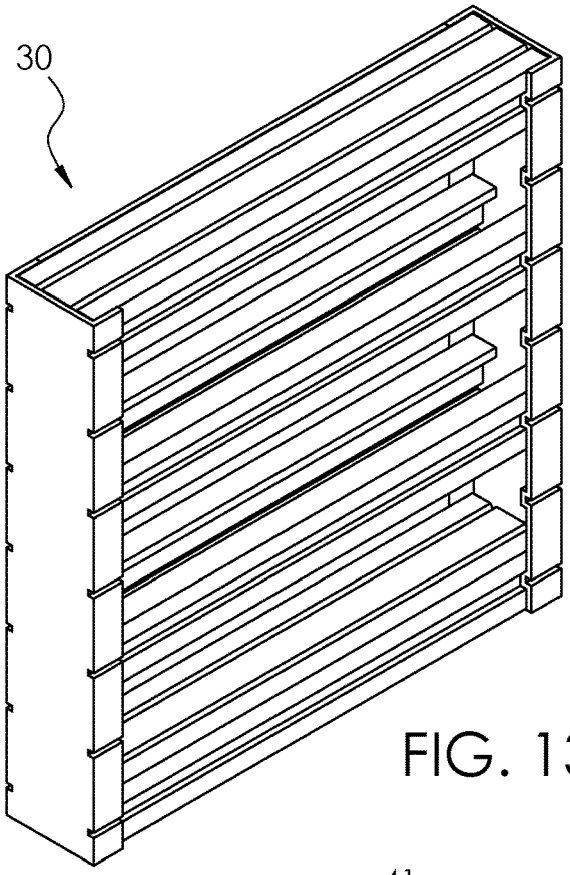
FIG. 13 is a perspective view of a stiff wall panel assembly wherein the wall panel is detachable from the tracks, each having ribs parallel to the studs, in accordance with a non-limiting exemplary embodiment of the present disclosure.
Figure 14:
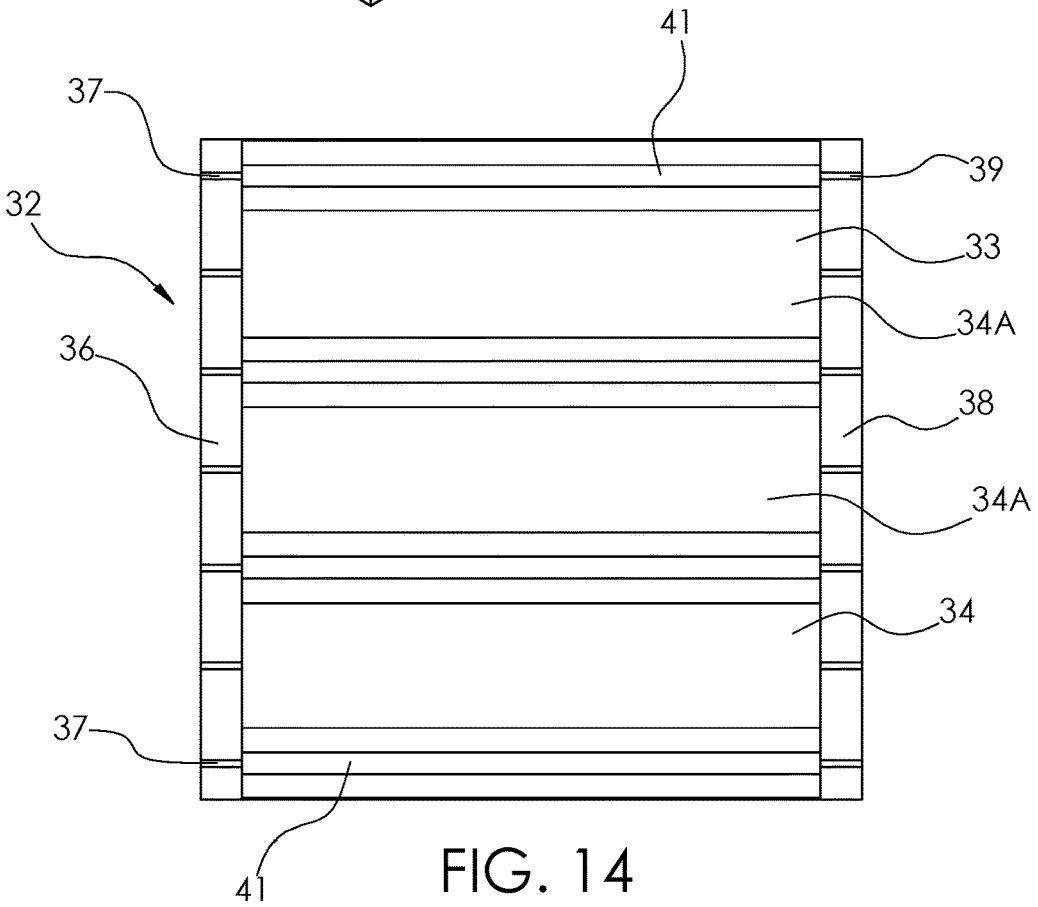
FIG. 14 is a rear elevational view of the stiff wall panel assembly shown in FIG. 13, in accordance with a non-limiting exemplary embodiment of the present disclosure.
Figure 15:
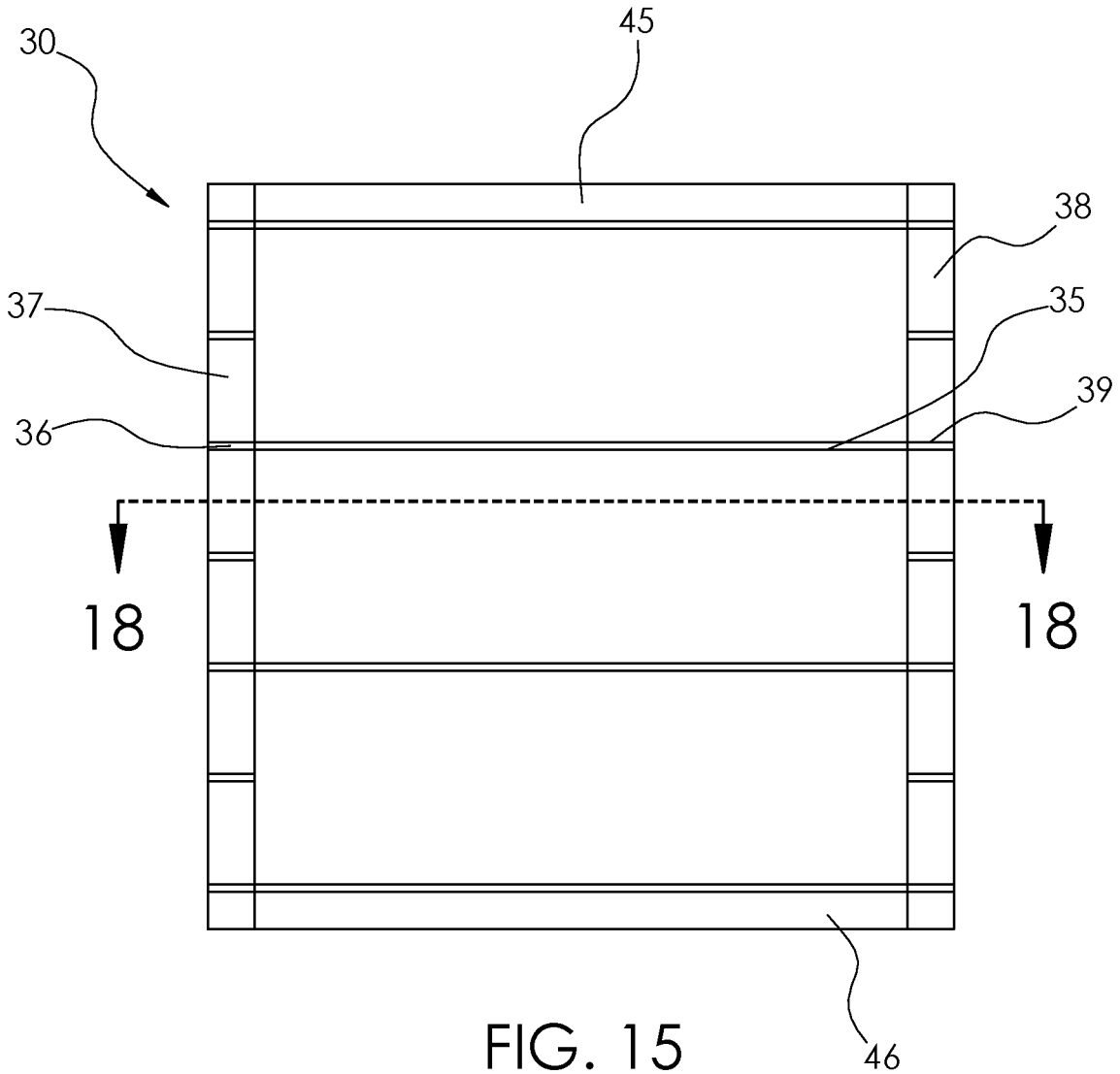
FIG. 15 is a front elevational view of the stiff wall panel assembly shown in FIG. 13, in accordance with a non-limiting exemplary embodiment of the present disclosure.
Figure 16:
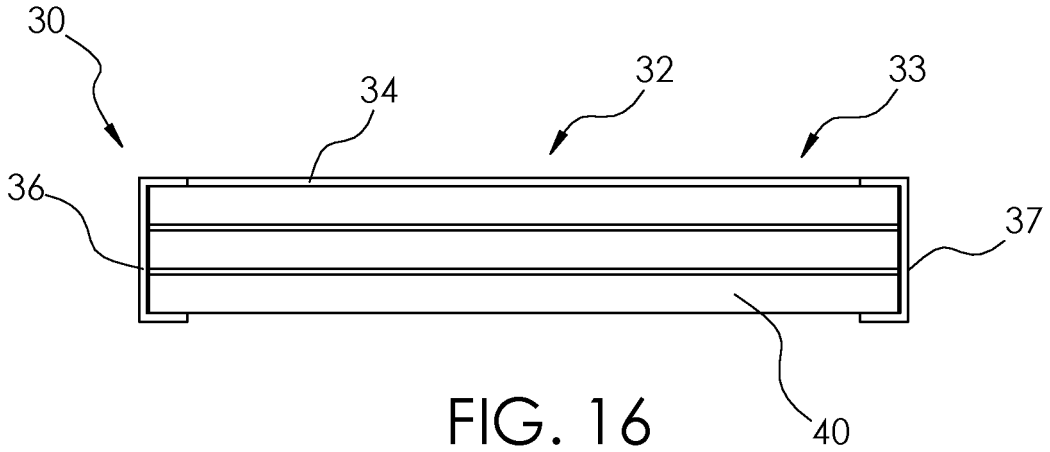
FIG. 16 is a top plan view of the stiff wall panel assembly shown in FIG. 13, in accordance with a non-limiting exemplary embodiment of the present disclosure.
Figure 17:
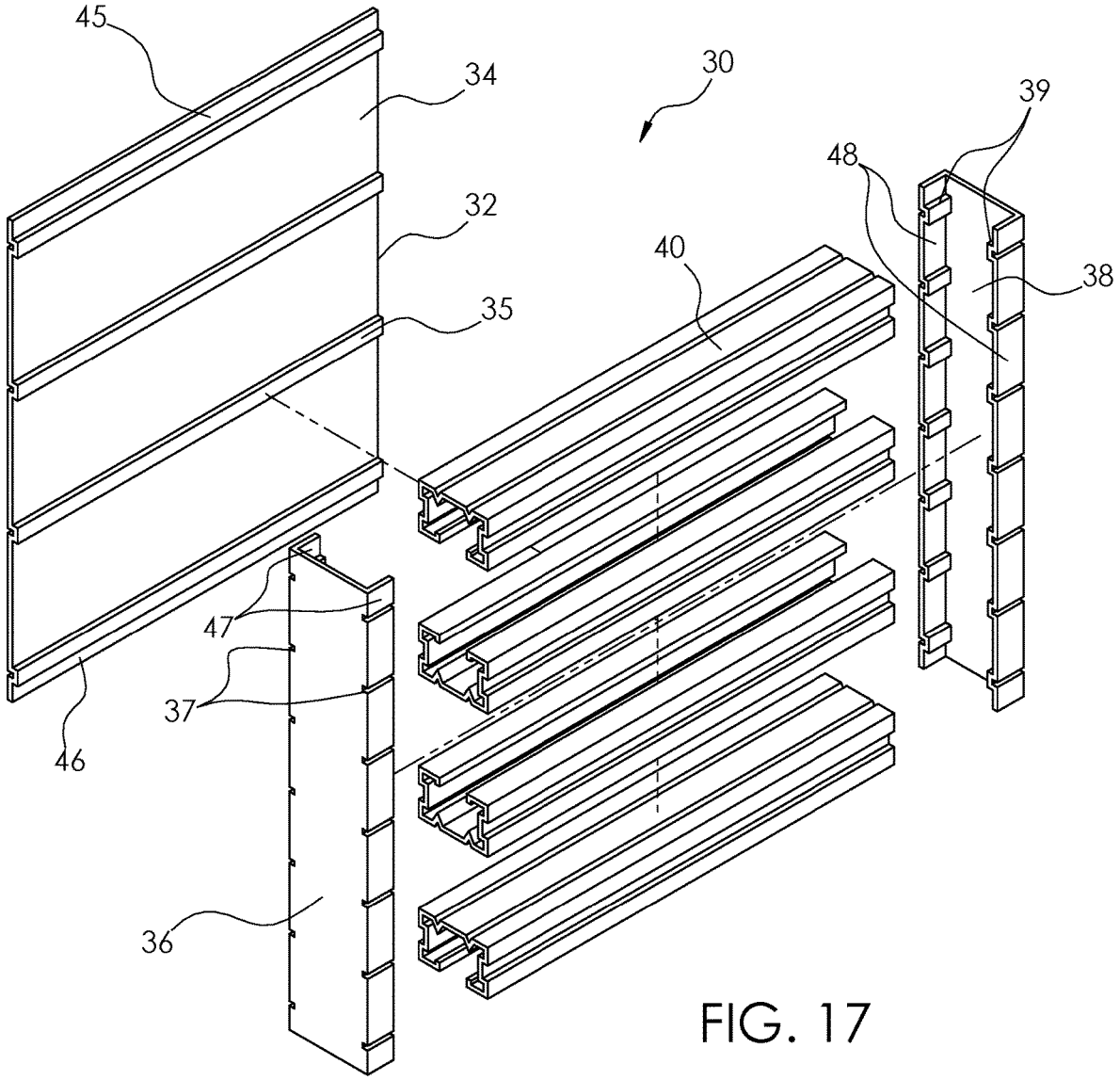
FIG. 17 is an exploded view of the stiff wall panel assembly shown in FIG. 13, in accordance with a non-limiting exemplary embodiment of the present disclosure.
Figure 18:
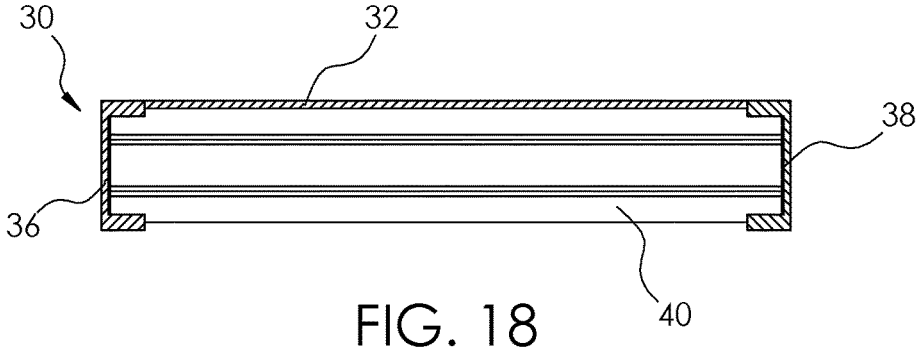
FIG. 18 is a cross-sectional view taken along line 18-18 in FIG. 15, in accordance with a non-limiting exemplary embodiment of the present disclosure.
Figure 19:
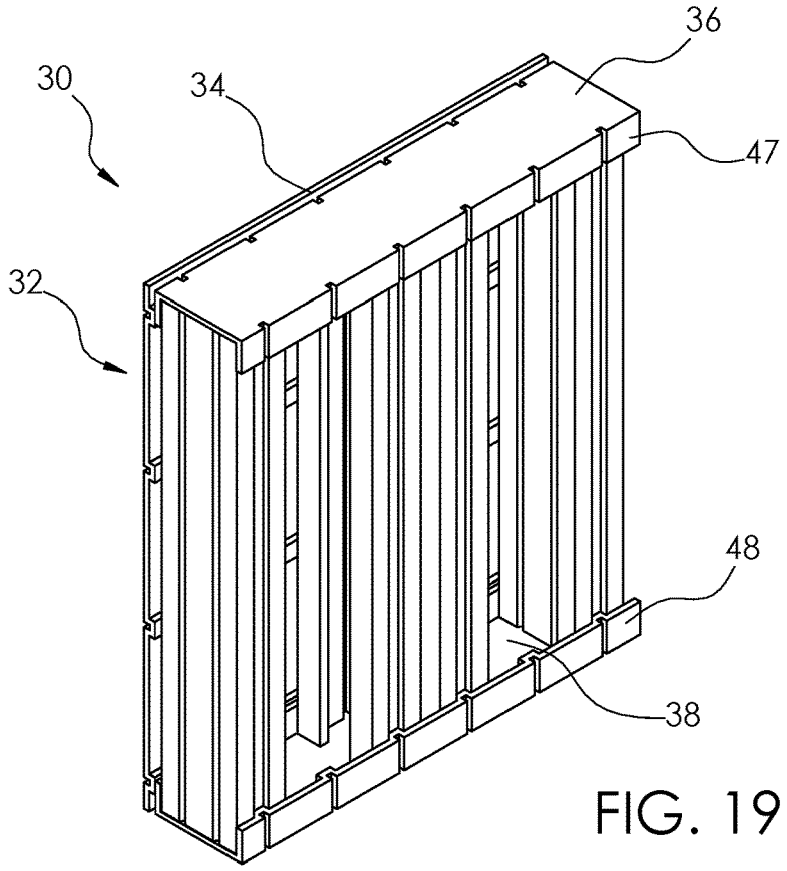
FIG. 19 is a perspective view of a stiff wall panel assembly wherein the wall panel is detachable from the tracks, each having ribs orthogonal and parallel to the studs, respectively, in accordance with a non-limiting exemplary embodiment of the present disclosure.
Figure 20:
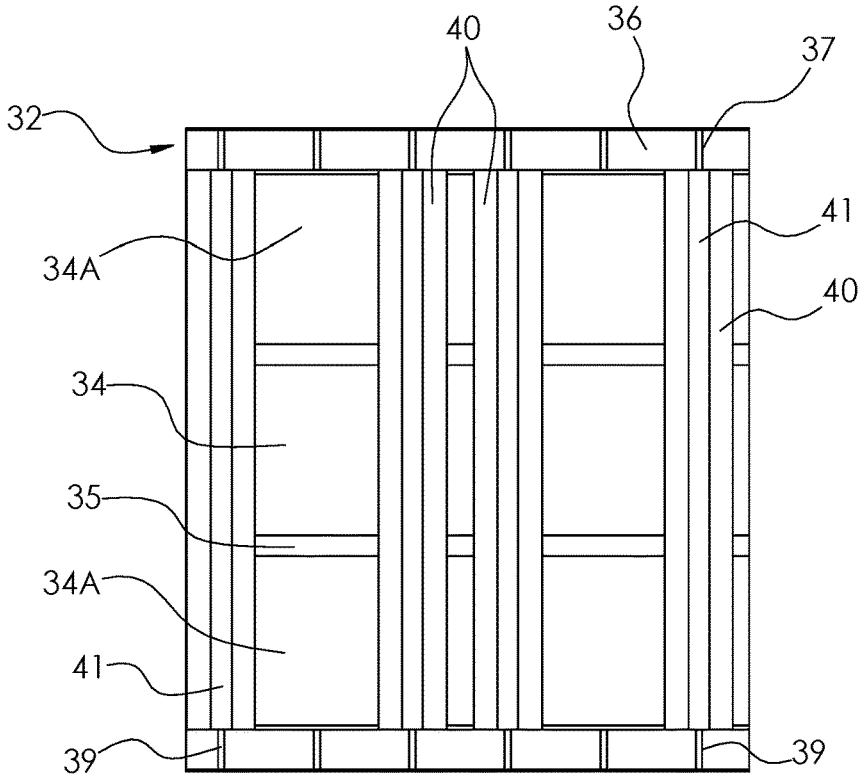
FIG. 20 is a rear elevational view of the stiff wall panel assembly shown in FIG. 19, in accordance with a non-limiting exemplary embodiment of the present disclosure.
Figure 21:
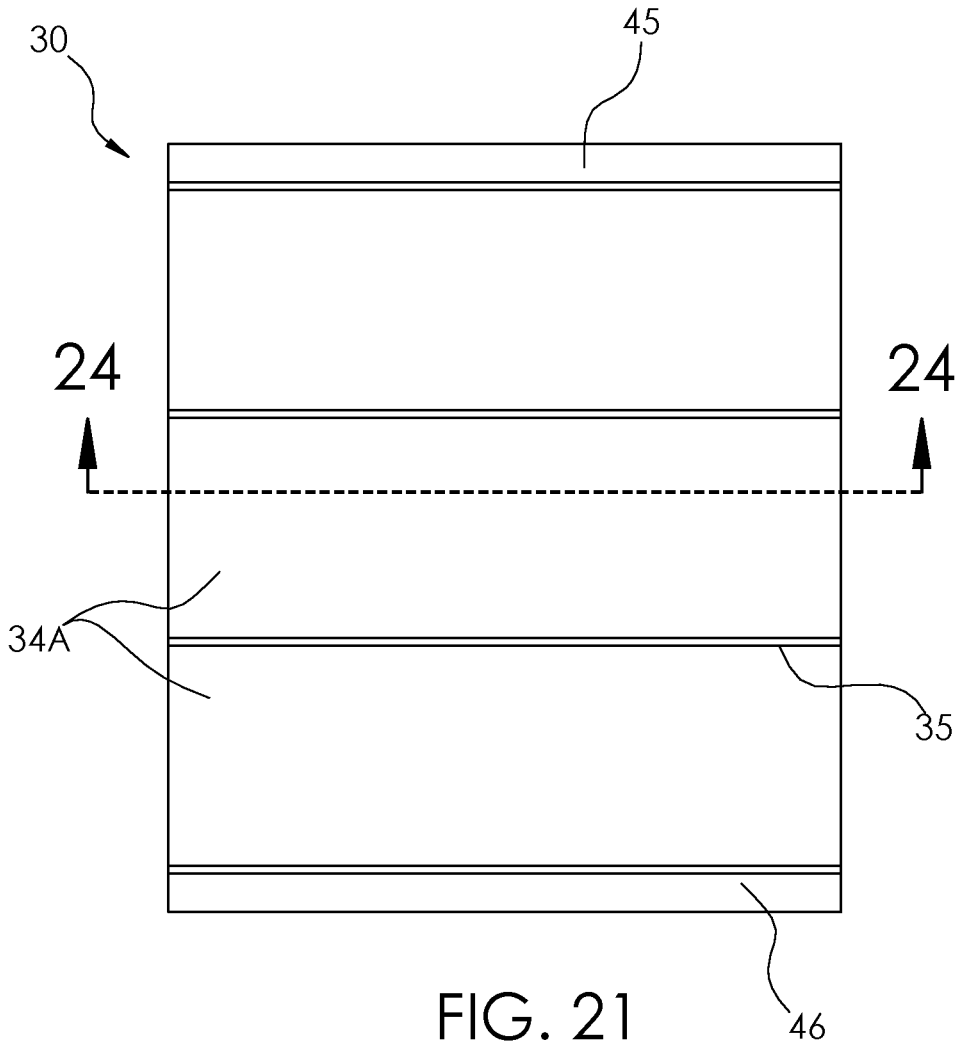
FIG. 21 is a front elevational view of the stiff wall panel assembly shown in FIG. 19, in accordance with a non-limiting exemplary embodiment of the present disclosure.
Figure 22:
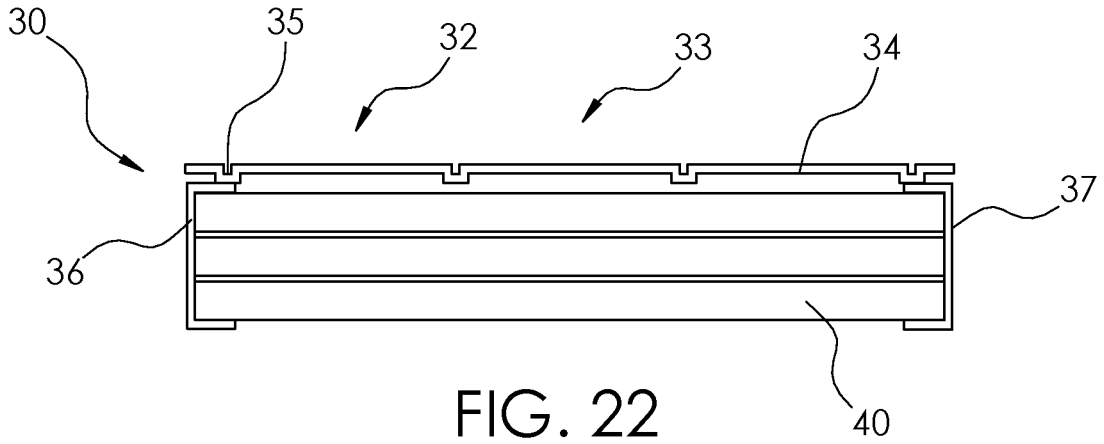
FIG. 22 is a side elevational view of the stiff wall panel assembly shown in FIG. 19, in accordance with a non-limiting exemplary embodiment of the present disclosure.
Figure 23:
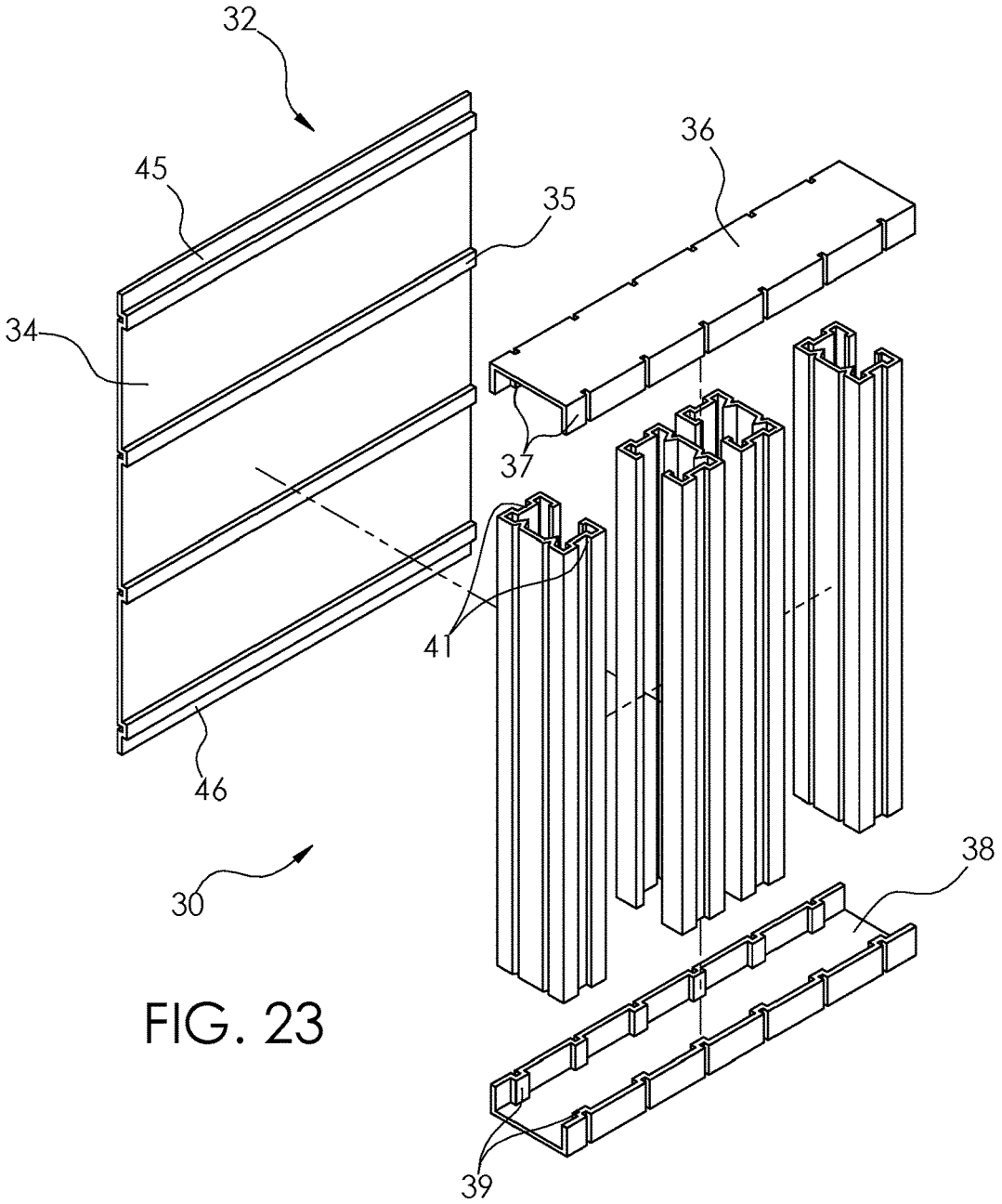
FIG. 23 is an exploded view of the stiff wall panel assembly shown in FIG. 19, in accordance with a non-limiting exemplary embodiment of the present disclosure.
Figure 24:
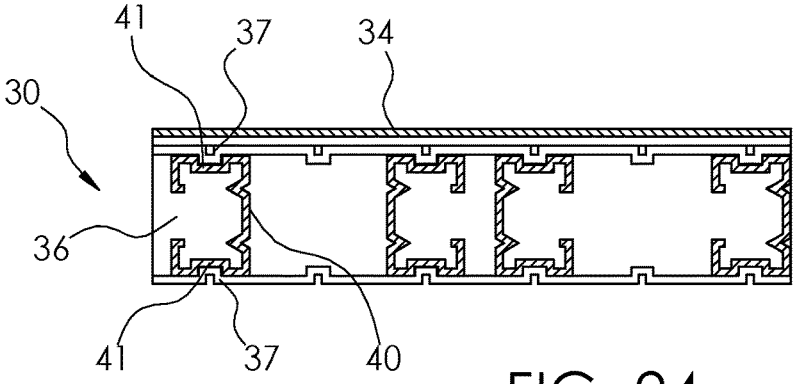
FIG. 24 is a cross-sectional view taken along line 24-24 in FIG. 21, in accordance with a non-limiting exemplary embodiment of the present disclosure.
Figure 25:
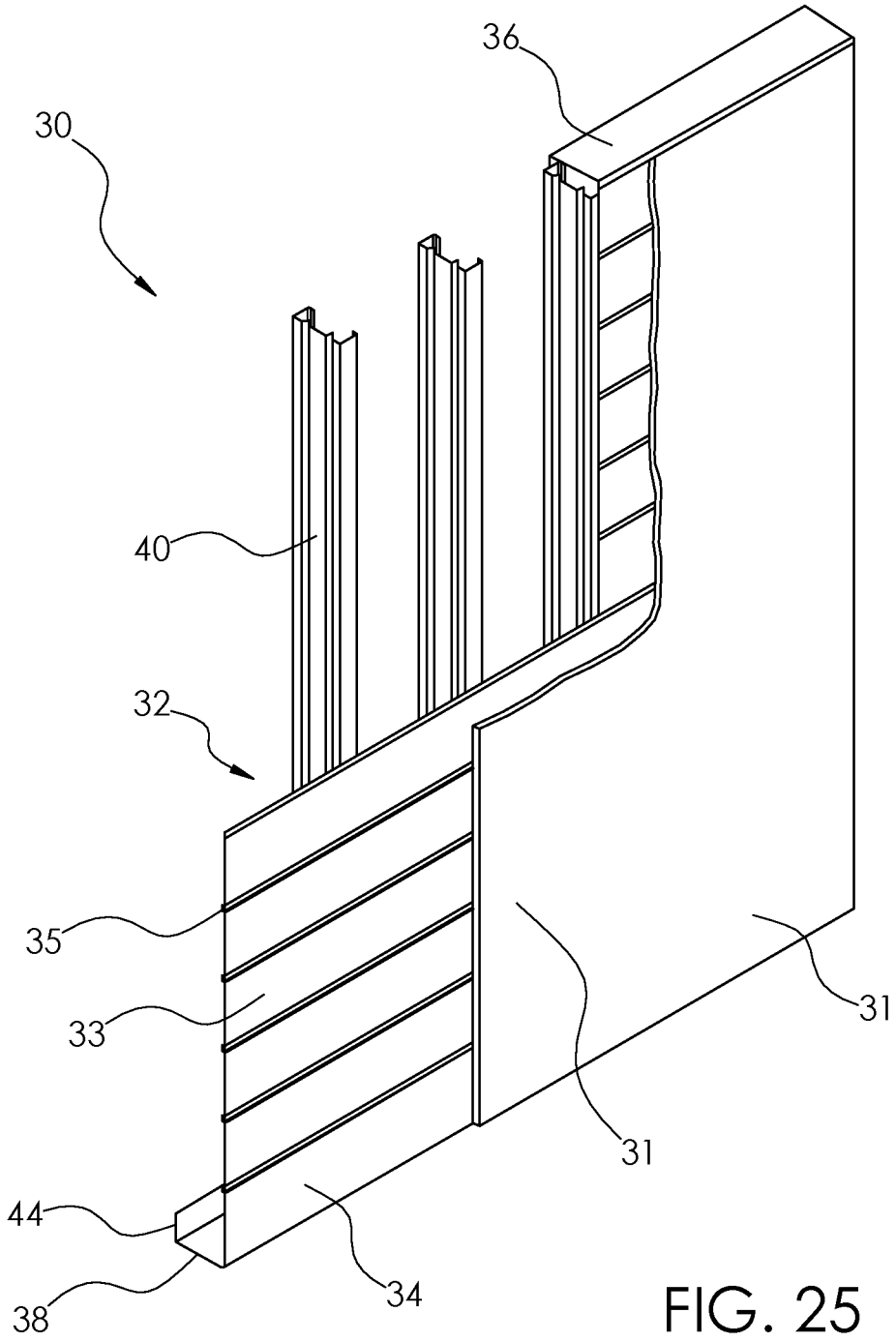
FIG. 25 is a partially exposed perspective view of a stiff wall panel assembly having a sheathing affixed to a front surface thereof, in accordance with a non-limiting exemplary embodiment of the present disclosure.
Figure 26:
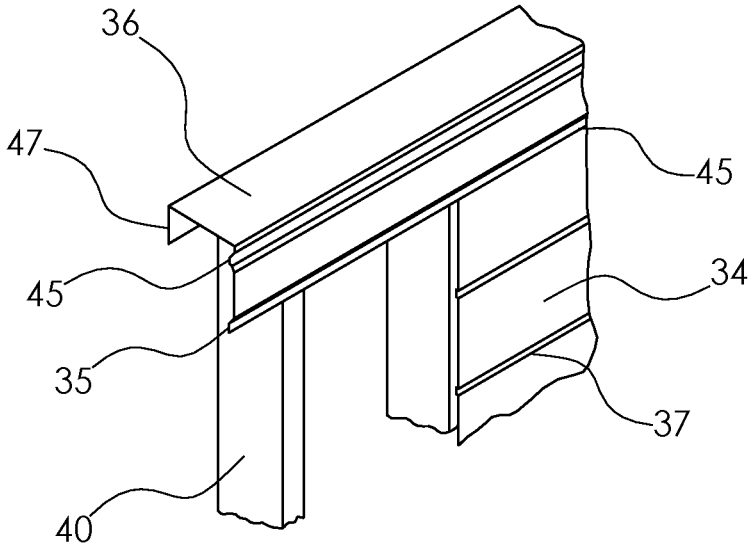
FIG. 26 is a perspective view of a stiff wall panel assembly having a portion of a wall panel extended along the top wall track, in accordance with a non-limiting exemplary embodiment of the present disclosure.
Figure 27:
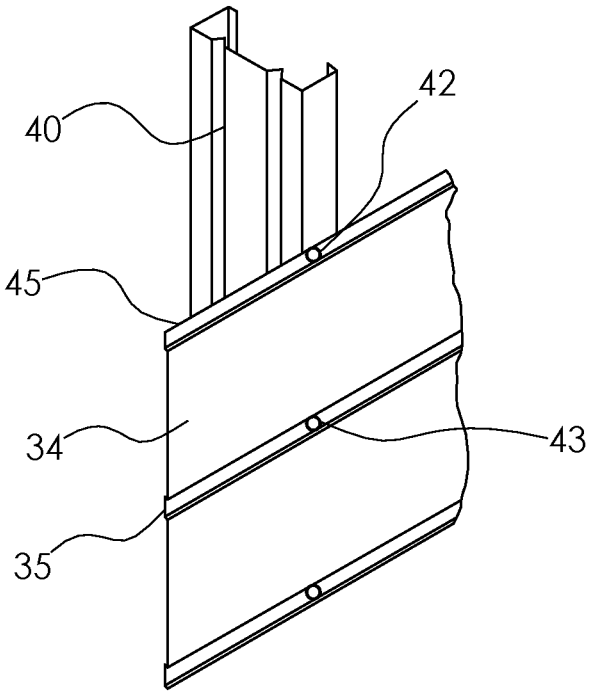
FIG. 27 is a perspective view of a stiff wall panel assembly wherein the wall panel is affixed, via a fastener, to the orthogonally oriented stud, in accordance with a non-limiting exemplary embodiment of the present disclosure.
Figure 28:
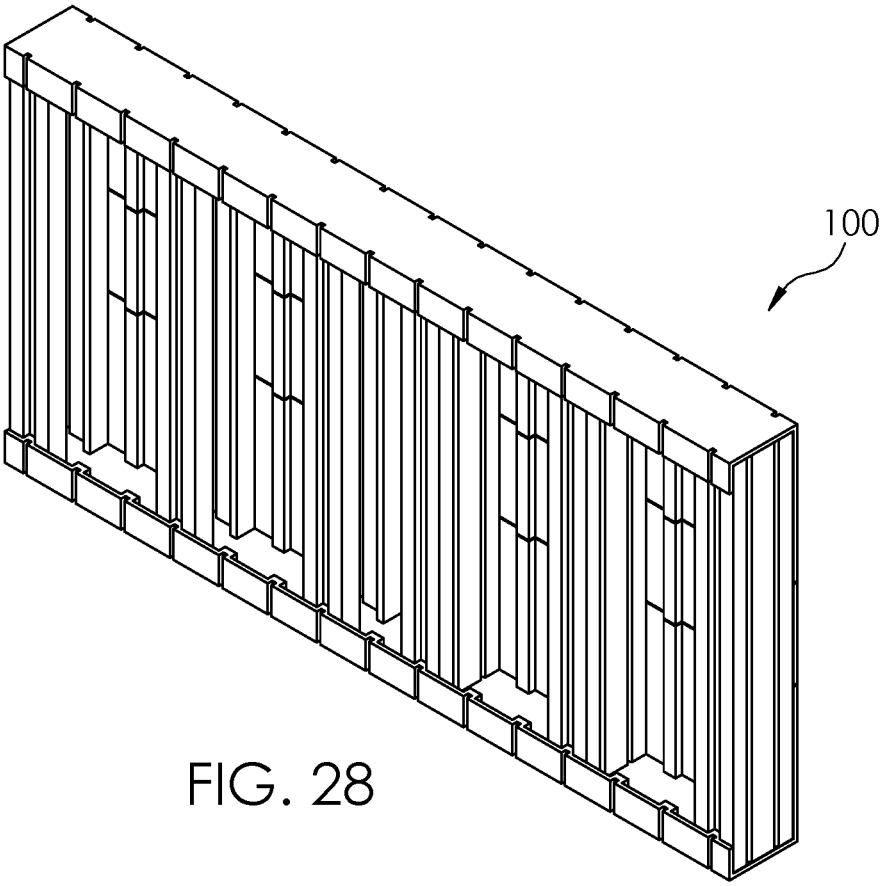
FIG. 28 is a perspective view of a modular stiff wall panel assembly employing conventional studs without reinforcing ribs, in accordance with a non-limiting exemplary embodiment of the present disclosure.
Figure 29:
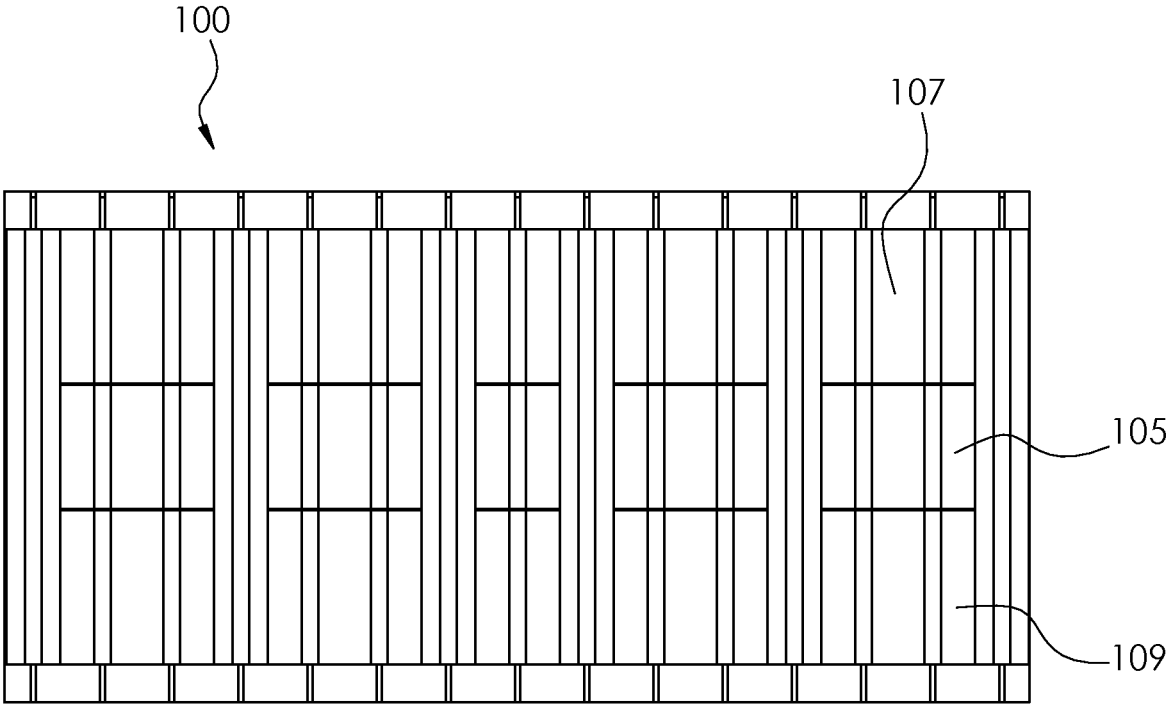
FIG. 29 is a front elevational view of the modular stiff wall panel assembly shown in FIG. 28, in accordance with a non-limiting exemplary embodiment of the present disclosure.
Figure 30:
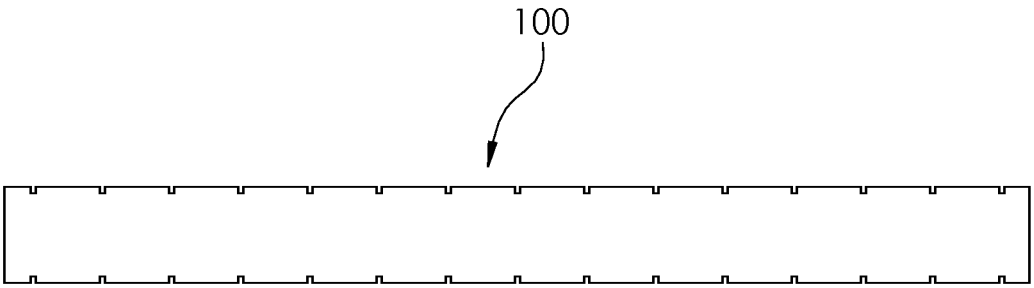
FIG. 30 is a top plan view of the modular stiff wall panel assembly shown in FIG. 28, in accordance with a non-limiting exemplary embodiment of the present disclosure.
Figure 31:
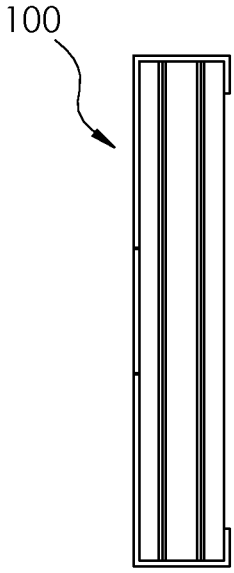
FIG. 31 is a side elevational view of the modular stiff wall panel assembly shown in FIG. 28, in accordance with a non-limiting exemplary embodiment of the present disclosure.
Figure 32:
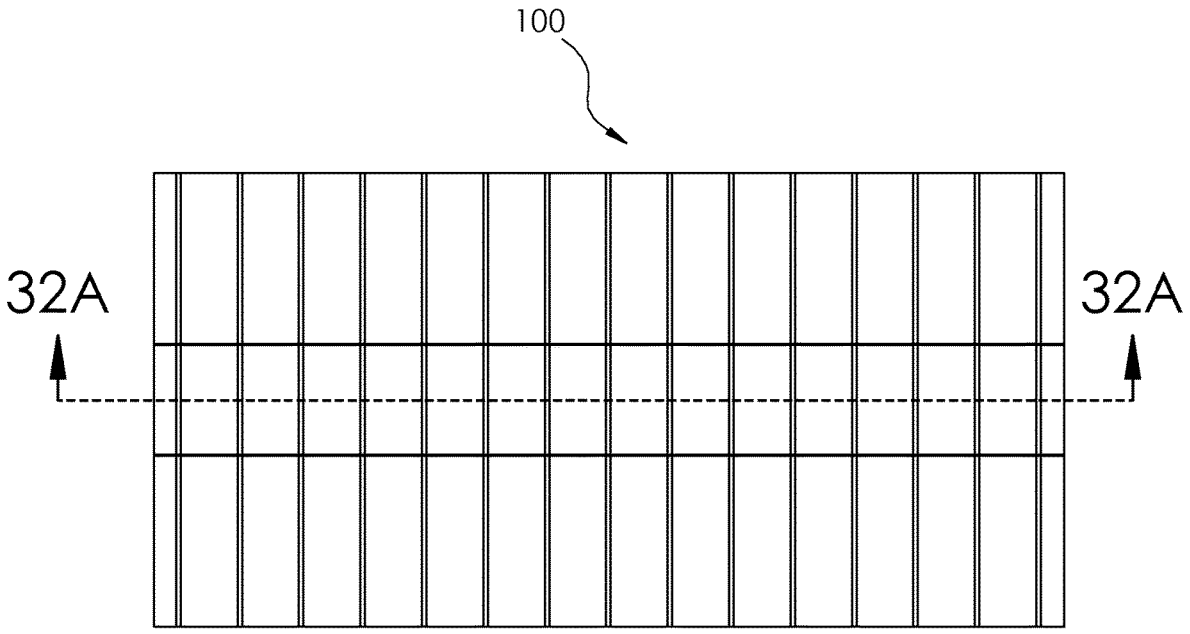
FIG. 32 is a rear elevational view of the modular stiff wall panel assembly shown in FIG. 28, in accordance with a non-limiting exemplary embodiment of the present disclosure.
Figure 32A:
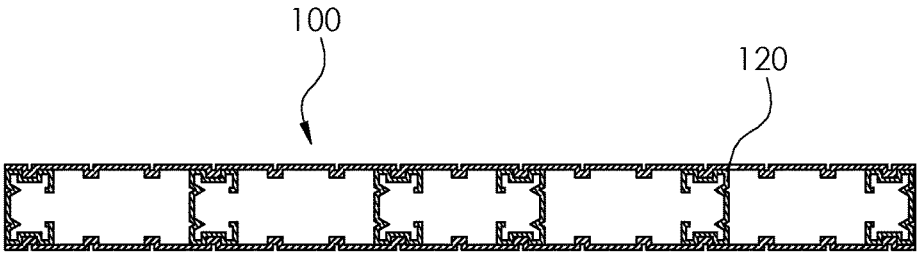
FIG. 32A is a cross-sectional view taken along lien 32A-32A in FIG. 32, in accordance with a non-limiting exemplary embodiment of the present disclosure.
Figure 33:
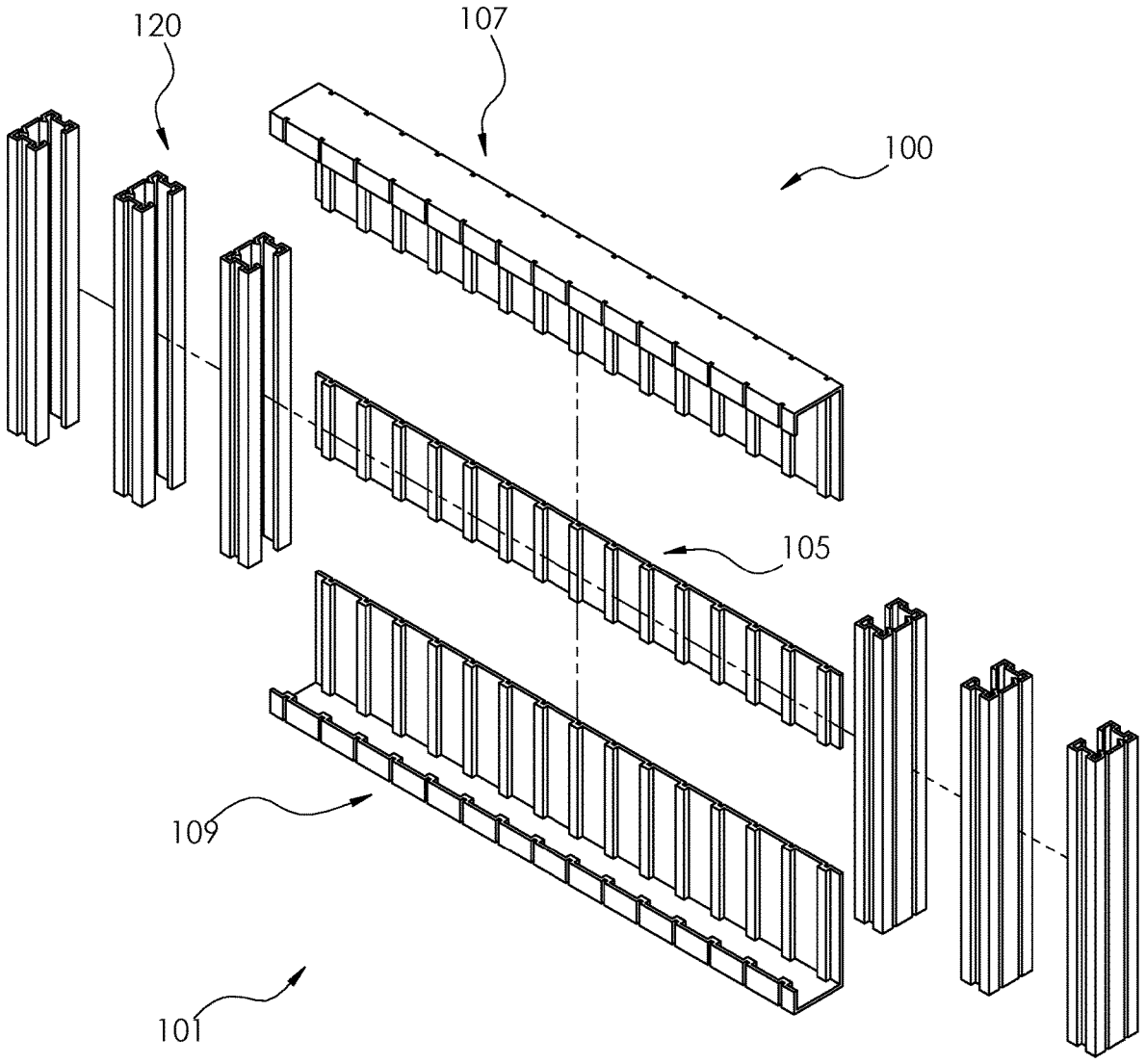
FIG. 33 is an exploded view of the modular stiff wall panel assembly shown in FIG. 28, in accordance with a non-limiting exemplary embodiment of the present disclosure.
Figure 34:
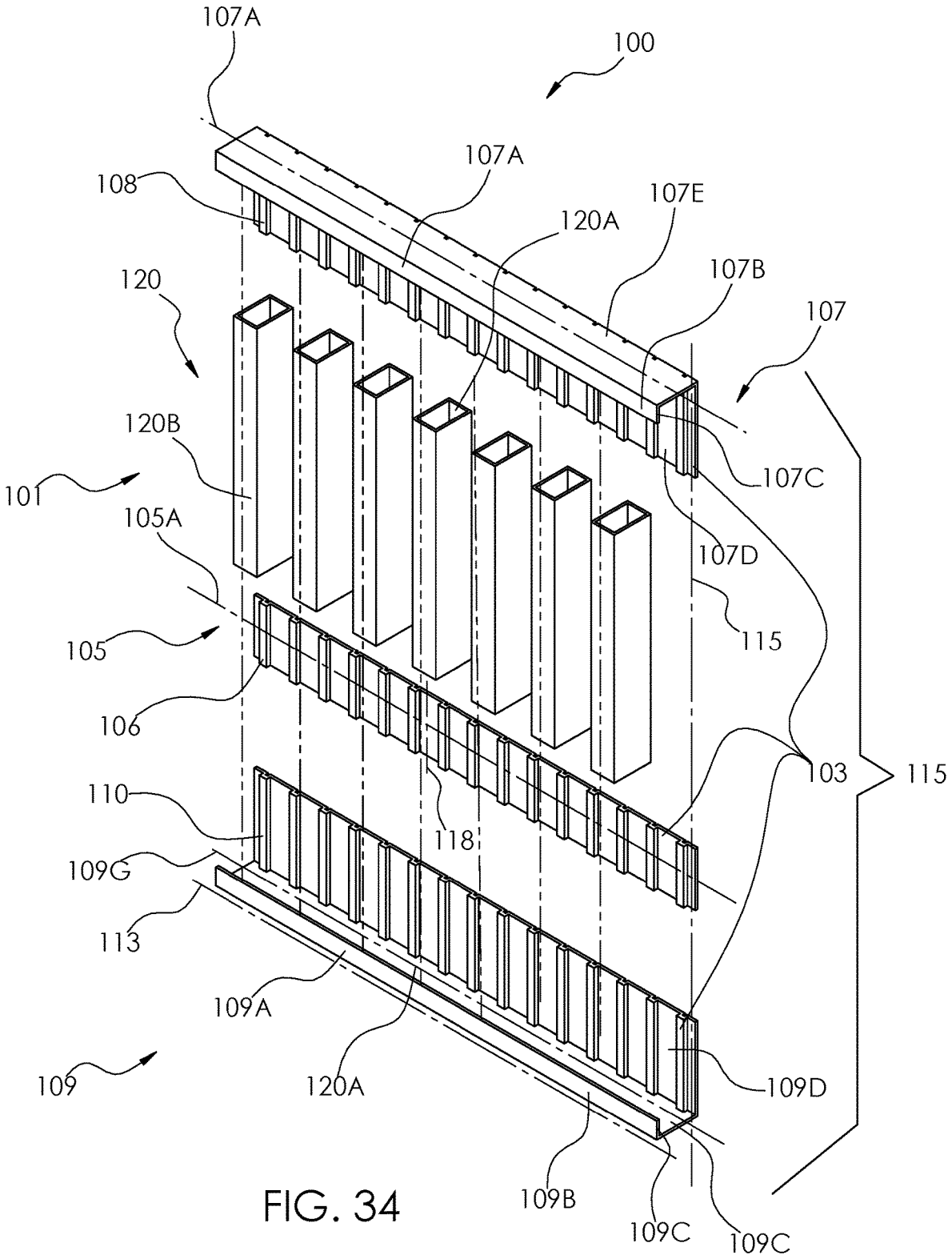
FIG. 34 is an exploded view of another modular stiff wall panel assembly without reinforcing ribs at its stiffening lips and with vertical conventional studs without reinforcing ribs, in accordance with a non-limiting exemplary embodiment of the present disclosure.

In a non-limiting exemplary embodiment, FIG. 34, each of the longitudinal length 101*a* of the modular wall panel 101 and the longitudinal axis 120*a* of the studs 120 is oriented orthogonal to a horizontal ground surface 113.

Figure 35:
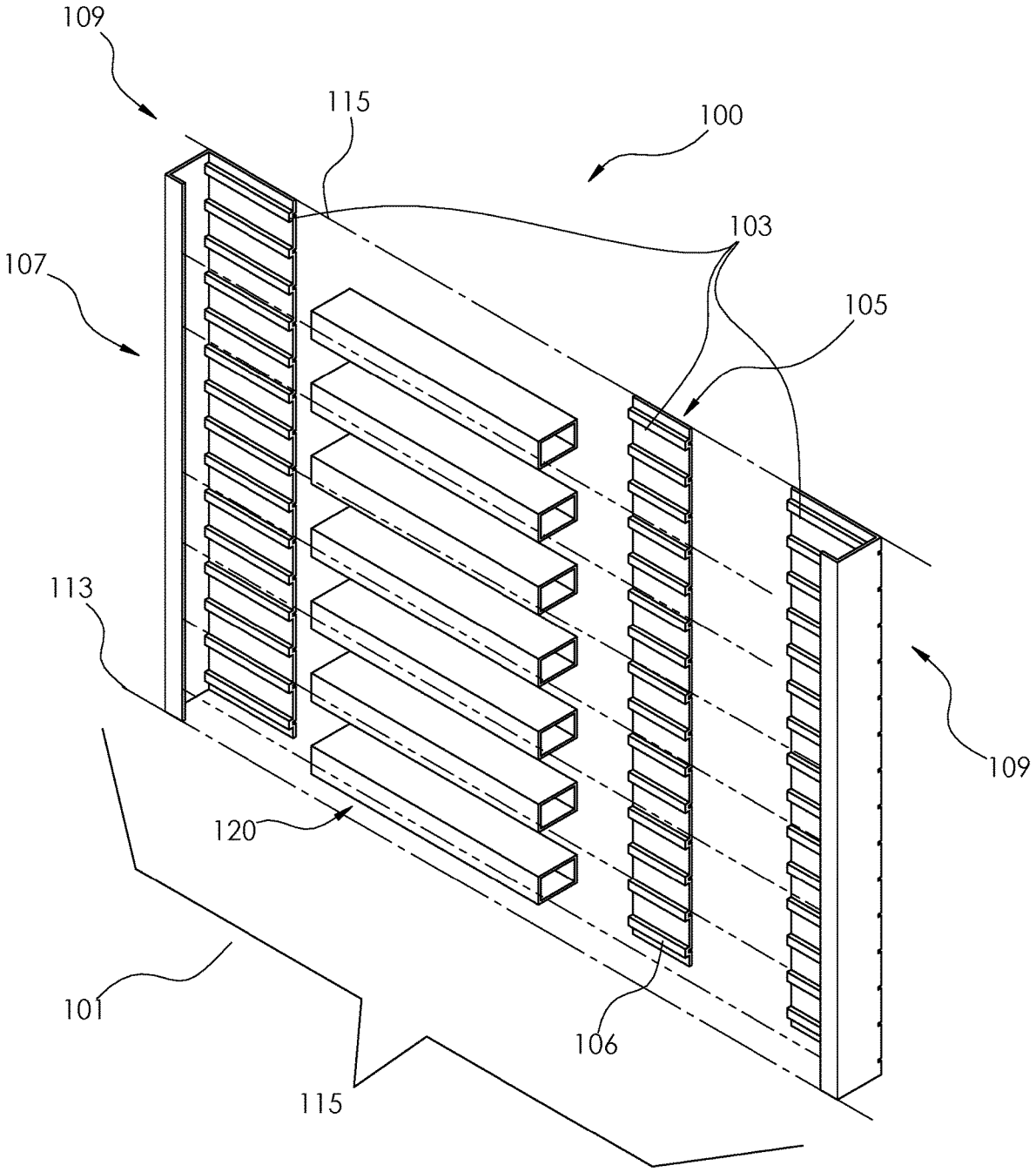
FIG. 35 is an exploded view of another modular stiff wall panel assembly without reinforcing ribs at its stiffening lips and with horizontal conventional studs without reinforcing ribs, in accordance with a non-limiting exemplary embodiment of the present disclosure.

In a non-limiting exemplary embodiment, FIG. 35, each of the longitudinal length 101*a* of the modular wall 101 panel and the longitudinal axis 120*a* of the studs 120 is oriented parallel to a horizontal ground surface 113.

In a non-limiting exemplary embodiment, the central ribs 106 are equidistantly spaced along the central portion 105 and registered orthogonal to a longitudinal axis 105*a* of the central portion 105.

In a non-limiting exemplary embodiment, the first ribs 108 are registered orthogonal to a longitudinal axis 107*g* of the first wall track 107.

In a non-limiting exemplary embodiment, the second ribs 110 are registered orthogonal to a longitudinal axis 109*g* of the second wall track 109.

In a non-limiting exemplary embodiment, the first wall track 107 is oriented parallel to the second wall track 109 and spaced apart therefrom.

In a non-limiting exemplary embodiment, the central ribs 106 are integral with the central portion 105 and linearly parallel to a latitudinal axis 118 thereof.

In a non-limiting exemplary embodiment, the central ribs 106 are parallel to the first ribs 108 and the second ribs 110.

In a non-limiting exemplary embodiment, the central ribs 106, the first ribs 108, and the second ribs 110 are linearly disposed along the single plane 115.

In a non-limiting exemplary embodiment, each of the first ribs 108, the second ribs 110, and the central ribs 106 are rectilinear.

In a non-limiting exemplary embodiment, a plurality of fasteners (not shown) may be connected to a plurality of abutted edges of the first wall track 107, the second wall track 109, and the central portion 105, respectively.

In a non-limiting exemplary embodiment, the central portion 105 is removably attached to the studs 120.

In a non-limiting exemplary embodiment, each of the first wall track 107 and the second wall track 109 has a single stiffening lip 107*a*, 109*a* longitudinally extended orthogonal to the studs 120 and oppositely spaced from the central portion 105. Advantageously, the first ribs 108 and the second ribs 110 are spaced from the single stiffening lip 107*a*, 109*a*, respectively. This allows studs 120 to be reinforced at the first wall track 107 and second wall track 109 and thereby improve shear load resistance and tensional load resistance.

In a non-limiting exemplary embodiment, the central portion 105 is separate from and detachably coupled to each of the first wall track 107 and the second wall track 109.

In a non-limiting exemplary embodiment, each single stiffening lip 107*a*, 109*a* has a continuous planar anterior face 107*b*, 109*b* and a continuous planar posterior face 107*c*, 109*c*, respectively.

In a non-limiting exemplary embodiment, the first wall track 107 includes a first primary side 107*d* having first ribs 108, a first base 107*e* integral with the first primary side 107*d* and oriented perpendicular thereto, and a first stiffening lip 107*a* integral with the first base 107*e* and oriented perpendicular thereto. Advantageously, the first stiffening lip 107*a* is spaced from the first ribs 108 and has a first planar anterior face 107*b* as well as a first planar posterior face 107*c* oriented parallel to the first primary side 107*d*. Advantageously, a proximal end 120*a* of studs 120 is intercalated between the first primary side 107*d* and the first stiffening lip 107*a*. This allows studs 120 to be reinforced at the first wall track 107 and thereby improves shear load resistance and tensional load resistance.

In a non-limiting exemplary embodiment, the second wall track 109 includes a second primary side 109*d* having the second ribs 110, a second base 109*e* integral with the second primary side 109*d* and oriented perpendicular thereto, and a second stiffening lip 109*a* integral with the second base 109*e* and oriented perpendicular thereto. Advantageously, the second stiffening lip 109*a* is spaced from the second ribs 110 and has a second planar anterior face 109*b* as well as a second planar posterior face 109*c* oriented parallel to the second primary side 109*d*. Advantageously, a distal end 120*b* of studs 120 is intercalated between the second primary side 109*d* and the second stiffening lip 109*a*. This allows studs 120 to be reinforced at second wall track 109 and thereby improves shear load resistance and tensional load resistance.

In a non-limiting exemplary embodiment, the central ribs 106 begin and terminate at the central portion 105. Advantageously, the first ribs 108 begin and terminate at the first wall track 107 and the second ribs 110 begin and terminate at the second wall track 109.

In a non-limiting exemplary embodiment, each of the studs 120 has a proximal end 120*a* and a distal end 120*b* directly abutted with the first wall track 107 and the second wall track 109, respectively.

Referring to FIGS. 36-43, in a non-limiting exemplary embodiment, the assembly 300 includes a wall panel 301, studs 304 (e.g., STRONG STUD™), and associated external and internal reinforcement members 305, 306, respectively, at opposed sides of the wall panel 301. Such external and internal reinforcement members 305, 306, respectively, provide improved resistance against shear forces and moment forces exerted on the wall panel 301 having load bearing wall studs 304, columns, truss members, curtain walls, headers, etc. The stud 304 may be directly affixed to the internal reinforcement members 306, which allows the use of light weight steel in load bearing structures. Utilizing the high axial capacity of the stud 304 allows for successful value engineering in structural steel and concrete systems, thereby significantly reducing the project costs.

In a non-limiting exemplary embodiment, experimental testing was performed to determine the allowable axial load based on axial and lateral load combinations. Data was gathered from such experimental tests by using predetermined standard base steel thickness. In conformance with American Iron and Steel Institute (AISI) specifications, the actual delivered base steel thickness must not be less than ninety-five percent of the thicknesses listed. The experimental tests showed increased levels of allowable axial loads on studs 304 subjected to lateral loadings. The loads were based on continuous weak axis and torsional lateral bracing spaced at 48 inches on center. The ends of studs 304 were fastened to a continuous bottom track 310 to prevent rotation. Exerted test loads were limited to studs 304 of a simple span condition.

In a non-limiting exemplary embodiment, the experimental test results showed that wall panel assembly 300 having external and internal reinforcement members 305, 306, respectively, increased performance in construction of load bearing walls, exterior curtain walls and headers, as well as floor and roof truss assemblies while maintaining or decreasing cost. The external and internal reinforcement members 305, 306, respectively, used in the assembly 300 allow for increased axial loading capabilities only available in traditional studs 304 at heavier gauges. The utilization of stud 304 for truss members eliminates the need for lateral web bracing. Thus, stud 304 is stronger and lighter than conventional stud shapes. As a result, trusses employing assembly 300 are commonly up to forty percent lighter than conventional trusses that do not employ stud 304 and external and internal reinforcement members 305, 306.

In a non-limiting exemplary embodiment, the experimental test results further showed that studs 304 including at least one stiffener 340 provide superior performance for uniform joist loading. For example, stud 304 can be made of a lighter gauge (less weight) material and provide superior strength to a conventional stud made of greater gauge (more weight) material. Experimental tests were performed for a twenty gauge stud 304 versus a twenty gauge conventional stud. Stud 304 surpassed the conventional stud's axial capacity by nearly one ton.

In a non-limiting exemplary embodiment, internal reinforcement members 306 on the interior side of studs 304 are separate from the wall panel 301. The external reinforcement members 305 on the exterior of the wall panel 301 are part of wall panel 301.

In a non-limiting exemplary embodiment, the studs 304 can be any generic stud 304 (e.g., 2×6 wood stud, 2×6 metal stud, etc.) that does not include stiffeners 340.

In a non-limiting exemplary embodiment, the wall panel 301 may terminate approximately six inches below a top end 304*a* of the stud 304. Roof trusses or floor joists shear connect to the stud 304 top end 304*a* above the wall panel 301.

In a non-limiting exemplary embodiment, a total wall thickness of assembly 300 may be approximately 8⅜ inches using a six inch stud 304. The interior and exterior reinforcement members 305, 306, respectively, laterally brace the studs 304 at 16 inch or 24 inch on center increasing the load capacity of the stud 304.

In a non-limiting exemplary embodiment, the studs 304 are placed between about 24 to 48 inches on center. This results in up to fifty percent less studs 304. The assembly 300 also provides impact, wind, seismic, fire ratings and can be the finished exterior building structure using painted materials. Net results are lighter total weights, fifty percent less trusses for roof or floor, as well as less labor and greater insulated space.

In a non-limiting exemplary embodiment, material and labor costs are further saved by not having a top track, and by integrally building the bottom track 310 with the central portion 308 from one sheet of metal. The top connections to the top end 304*a* of the studs 304 are without clips or angles because of shear connections.

In a non-limiting exemplary embodiment, by affixing the exterior reinforcement members 305 to an exterior side of the central portion 308, a finish board can be installed and attached to the exterior reinforcement members 305 at 24 or 16 inches on center. By using the shear connections, a laser line can be shot around the perimeter of the wall panel assembly 300 to ensure a level roof if foundation is not level. Commercial, low income, or emergency housing can utilize the wall panel assembly 300 as a finished product.

In a non-limiting exemplary embodiment, the interior reinforcement members 306 can be used to receive an interior wall (dry wall, ship lap, etc.) of the building structure.

Referring to FIGS. 36-43, a non-limiting embodiment of the present disclosure illustrates a modular stiff wall panel assembly 300 for a building structure. Such an assembly 300 includes a modular wall panel 301 including a modular body 302 having a single, continuous, and unitary layer 303 extended along an entire surface area of the wall panel 301, a plurality of studs 304 statically engaged with the single, continuous, and unitary layer 303, a plurality of external reinforcement members 305 statically engaged with the single, continuous, and unitary layer 303, and a plurality of internal reinforcement members 306 statically engaged with the studs 304 and remain oppositely spaced from the external reinforcement members 305. Advantageously, each of the external reinforcement members 305 and the internal reinforcement members 306 have a hat-shaped cross-section (profile) 307. Such a structural configuration yields the new, useful, and unexpected results of improved resistance to external loads while reducing the weight and quantity of studs 34.

In a non-limiting exemplary embodiment, the single, continuous, and unitary layer 303 includes a central portion 308, and a bottom wall track 310 engaged with the central portion 308 and further has a plurality of bottom ribs 309 spaced therealong. Notably, the studs 304 are engaged with the central portion 308 and the bottom wall track 310. Advantageously, the external reinforcement members 305 are engaged with the central portion 308 as well. Such a structural configuration yields the new, useful, and unexpected results of improved resistance to external loads while reducing the weight and quantity of studs 34.

In a non-limiting exemplary embodiment, each of the external reinforcement members 305 and the internal reinforcement members 306 includes a first side 315 and a second side 316 converging laterally away therefrom (towards central axis 345), and a central side 317 having axially opposed edges 317*a*, 317*b*, respectively. Such edges 317*a*, 317*b* are directly and integrally attached to each of the first side 315 and the second side 316, respectively. Advantageously, the central side 317 defines a central apex 318 of each external reinforcement members 305 and internal reinforcement members 306. Advantageously, the central side 317 is rectilinear and planar. Such a structural configuration yields the new, useful, and unexpected results of improved resistance to external loads while reducing the weight and quantity of studs 34.

In a non-limiting exemplary embodiment, each of the external reinforcement members 305 and the internal reinforcement members 306 further includes a fifth side 319 integrally connected to the first side 315 and extended laterally away therefrom (as well as a central axis 345), and a sixth side 320 integrally connected to the second side 316 and extended laterally away therefrom in a direction opposite to the fifth side 319. Advantageously, both the fifth side 319 and the sixth side 320 are rectilinear and coplanar. Such a structural configuration yields the new, useful, and unexpected results of improved resistance to external loads while reducing the weight and quantity of studs 34.

In a non-limiting exemplary embodiment, each stud 304 include at least one stiffener 340 that linearly extends along an entire longitudinal length 329 of the associated stud 304. Advantageously, the central side 317 is intercalated between the first side 315 and the second side 316 such that the first side 315 is equidistantly offset from the second side 316 (and from the central axis 345). Such a structural configuration yields the new, useful, and unexpected results of improved resistance to external loads while reducing the weight and quantity of studs 34.

In a non-limiting exemplary embodiment, the external reinforcement members 305 and the internal reinforcement members 306 are linearly aligned, respectively, and registered orthogonal to a longitudinal axis 328 of the studs 304, respectively. Advantageously, the external reinforcement members 305 and the internal reinforcement members 306 are located on two separate vertical planes 325, 326, respectively, and oppositely disposed such that the central portion 308 and the studs 304 are intercalated between the internal reinforcement members 306 and the external reinforcement members 305. Such a structural configuration yields the new, useful, and unexpected results of improved resistance to external loads while reducing the weight and quantity of studs 34.

In a non-limiting exemplary embodiment, each longitudinal length 346 of the wall panel 301 and a longitudinal axis 328 of the studs 304 is oriented orthogonal to a horizontal ground surface 330.

In a non-limiting exemplary embodiment, each external reinforcement members 305 and internal reinforcement members 306 has an associated longitudinal length 347, 347*a* oriented parallel to a horizontal ground surface 330.

In a non-limiting exemplary embodiment, the external reinforcement members 305 are equidistantly spaced along the central portion 308 and registered orthogonal to a longitudinal axis 348 of the central portion 308.

In a non-limiting exemplary embodiment, the bottom ribs 309 are registered orthogonal to a longitudinal axis 349 of the bottom wall track 310.

In a non-limiting exemplary embodiment, the internal reinforcement members 306 are registered orthogonal to a longitudinal axis 349 of the bottom wall track 310.

In a non-limiting exemplary embodiment, the external reinforcement members 305 are integral with the central portion 308 and linearly parallel to a latitudinal axis 332 thereof.

In a non-limiting exemplary embodiment, the external reinforcement members 305 are orthogonal to the bottom ribs 309.

In a non-limiting exemplary embodiment, the external reinforcement members 305, the bottom ribs 309, and the internal reinforcement members 306 are linearly disposed along an associated unique (different) plane.

In a non-limiting exemplary embodiment, each of the bottom ribs 309, the internal reinforcement members 306, and the external reinforcement members 305 are rectilinear.

In a non-limiting exemplary embodiment, the central portion 308 is removably attached to the studs 304.

In a non-limiting exemplary embodiment, the bottom wall track 310 has a single stiffening lip 333 longitudinally extended orthogonal to the studs 304 and oppositely spaced from the central portion 308. Advantageously, the bottom ribs 309 are integral with the single stiffening lip 333. Such a structural configuration yields the new, useful, and unexpected results of improved resistance to external loads while reducing the weight and quantity of studs 34.

In a non-limiting exemplary embodiment, the central portion 308 is integral with the bottom wall track 310. Such a structural configuration yields the new, useful, and unexpected results of improved resistance to external loads while reducing the weight and quantity of studs 34.

In a non-limiting exemplary embodiment, the bottom wall track 310 includes a base 334 integral with the first stiffening lip 333 and oriented perpendicular thereto. Advantageously, base 334 is integral with the central portion 308, and a bottom end 304*b* of each of the studs 304 is intercalated between the central portion 308 and the first stiffening lip 333. Such a structural configuration yields the new, useful, and unexpected results of improved resistance to external loads while reducing the weight and quantity of studs 34.

In a non-limiting exemplary embodiment, the external reinforcement members 305 begin and terminate at the central portion 308. Advantageously, the bottom ribs 309 begin and terminate at the bottom wall track 310. Such a structural configuration yields the new, useful, and unexpected results of improved resistance to external loads while reducing the weight and quantity of studs 34.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A stiff wall panel assembly for a building structure, comprising:

a wall panel including a body having a single, continuous, and unitary layer extended along an entire surface area of said wall panel;

a plurality of studs engaged with said single, continuous, and unitary layer;

a plurality of external reinforcement members being integral with said single, continuous, and unitary layer; and a plurality of internal reinforcement members engaged with said studs and oppositely spaced from said external reinforcement members;

wherein each of said external reinforcement members and said internal reinforcement members have a hat-shaped cross-section;

wherein said single, continuous, and unitary layer of said body of said wall panel has a substantially L-shape provided with a corrugated and non-smooth central portion, a flat bottom portion, and a corrugated and non-smooth bottom wall track extending vertically from the bottom portion;

wherein each of said studs has a second single, continuous, and unitary layer provided with an anterior side directly engaged with said corrugated and non-smooth central portion and a posterior side directly engaged with said corrugated and non-smooth bottom wall track;

wherein said central portion is integral with said bottom wall track.

2. The stiff wall panel assembly of claim 1, wherein said bottom wall track is engaged with said central portion and has a plurality of bottom ribs spaced therealong;

wherein said external reinforcement members are engaged with said central portion.

3. The stiff wall panel assembly of claim 2, wherein said external reinforcement members are equidistantly spaced along said central portion and registered orthogonal to a longitudinal axis of said central portion.

4. The stiff wall panel assembly of claim 2, wherein said bottom ribs are registered orthogonal to a longitudinal axis of said bottom wall track.

5. The stiff wall panel assembly of claim 2, wherein said internal reinforcement members are registered orthogonal to a longitudinal axis of said bottom wall track.

6. The stiff wall panel assembly of claim 2, wherein said external reinforcement members are integral with said central portion and linearly parallel to a latitudinal axis thereof.

7. The stiff wall panel assembly of claim 2, wherein said external reinforcement members are orthogonal to said bottom ribs.

8. The stiff wall panel assembly of claim 2, wherein said external reinforcement members, said bottom ribs, and said internal reinforcement members are linearly disposed along an associated unique plane; wherein said central portion is removably attached to said studs.

9. The stiff wall panel assembly of claim 2, wherein each of said plurality of bottom ribs, said internal reinforcement members, and said external reinforcement members are rectilinear.

10. The stiff wall panel assembly of claim 2, wherein said bottom wall track has a stiffening lip longitudinally extended orthogonal to said studs and oppositely spaced from said central portion, wherein said bottom ribs are integral with said stiffening lip.

11. The stiff wall panel assembly of claim 10, wherein said bottom wall track comprises:

a base integral with said stiffening lip and oriented perpendicular thereto;

wherein said base is integral with said central portion;

wherein a bottom end of each of said studs is intercalated between said central portion and said stiffening lip.

12. The stiff wall panel assembly of claim 1, wherein each of said external reinforcement members and said internal reinforcement members comprises:

a first side and a second side converging laterally away therefrom; and a central side having axially opposed edges directly and integrally attached to each of said first side and said second side;

wherein said central side defines an apex of each said external reinforcement members and said internal reinforcement members;

wherein said central side is rectilinear and planar.

13. The stiff wall panel assembly of claim 12, wherein each of said external reinforcement members and said internal reinforcement members further comprises:

a fifth side integrally connected to said first side and extended laterally away therefrom; and a sixth side integrally connected to said second side and extended laterally away therefrom in a direction opposite to said fifth side;

wherein both of said fifth side and said sixth side are rectilinear and coplanar.

14. The stiff wall panel assembly of claim 1, wherein said studs include at least one stiffener; wherein said at least one stiffener linearly extends along an entire longitudinal length of said studs; wherein a central side is intercalated between a first side and a second side such that said first side is equidistantly offset from said second side.

15. The stiff wall panel assembly of claim 1, wherein said external reinforcement members and said internal reinforcement members are linearly aligned, respectively, and registered orthogonal to a longitudinal axis of said studs, respectively;

wherein said external reinforcement members and said internal reinforcement members are located on two separate vertical planes, respectively, and oppositely disposed such that said central portion and said studs are intercalated between said internal reinforcement members and said external reinforcement members.

16. The stiff wall panel assembly of claim 1, wherein each of a longitudinal length of said wall panel and a longitudinal axis of said studs is oriented orthogonal to a horizontal ground surface.

17. The stiff wall panel assembly of claim 1, wherein each of said external reinforcement members and said internal reinforcement members has an associated longitudinal length oriented parallel to a horizontal ground surface.

18. The stiff wall panel assembly of claim 2, wherein said external reinforcement members begin and terminate at said central portion; wherein said bottom ribs begin and terminate at said bottom wall track.

19. A stiff wall panel assembly for a building structure, comprising:

a modular wall panel including a body having a single, continuous, and unitary layer extended along an entire surface area of said wall panel;

a plurality of studs statically engaged with said single, continuous, and unitary layer;

a plurality of external reinforcement members being integral with said single, continuous, and unitary layer; and a plurality of internal reinforcement members statically engaged with said studs and oppositely spaced from said external reinforcement members;

wherein each of said external reinforcement members and said internal reinforcement members have a hat-shaped cross-section;

wherein said single, continuous, and unitary layer of said body of said wall panel has a substantially L-shape provided with a corrugated and non-smooth central portion, a flat bottom portion, and a corrugated and non-smooth bottom wall track extending vertically from the bottom portion;

wherein each of said studs has a second single, continuous, and unitary layer provided with an anterior side directly engaged with said corrugated and non-smooth central portion and a posterior side directly engaged with said corrugated and non-smooth bottom wall track;

wherein said central portion is integral with said bottom wall track.

* * * * *